US011930986B2

(12) United States Patent
Büsing et al.

(10) Patent No.: US 11,930,986 B2
(45) Date of Patent: Mar. 19, 2024

(54) DISHWASHER

(71) Applicant: Samsung Electronics Co., Ltd., Suwon-si (KR)

(72) Inventors: Johannes Büsing, Suwon-si (KR); Woo Jin Shin, Suwon-si (KR); Chang Wook Lee, Suwon-si (KR); Sang Soo Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 199 days.

(21) Appl. No.: 16/530,038

(22) Filed: Aug. 2, 2019

(65) Prior Publication Data

US 2020/0046199 A1 Feb. 13, 2020

(30) Foreign Application Priority Data

Aug. 7, 2018 (KR) ..... 10-2018-0091814
Dec. 14, 2018 (KR) ..... 10-2018-0162212

(51) Int. Cl.
*A47L 15/50* (2006.01)

(52) U.S. Cl.
CPC ..... *A47L 15/507* (2013.01)

(58) Field of Classification Search
CPC ..... A47L 15/50; A47L 15/502; A47L 15/504; A47L 15/506; A47L 15/507
See application file for complete search history.

(56) References Cited

U.S. PATENT DOCUMENTS 3,672,743 A * 6/1972 Pompey ..... B60B 33/0063 312/352
3,679,282 A * 7/1972 Kauffman ..... A47B 88/487 312/311
3,744,646 A * 7/1973 Duncan ..... A47L 15/507 211/151

(Continued)

FOREIGN PATENT DOCUMENTS

CN 1957830 A 5/2007
CN 101103893 A 1/2008

(Continued)

OTHER PUBLICATIONS

International Search Report dated Oct. 18, 2019 in International Patent Application No. PCT/KR2019/007707.

(Continued)

*Primary Examiner* — David G Cormier
(74) *Attorney, Agent, or Firm* — STAAS & HALSEY LLP

(57) ABSTRACT

A dishwasher having a structure to prevent deformation of an accommodating container includes a main body, a tub provided inside the main body and including an opening, a door provided to open and close the opening of the tub, a guide rail mounted on an inner wall of the tub, an accommodating container provided to accommodate tableware and be movable along the guide rail, and including a front portion facing the opening and a rear portion, at least one roller rotatably mounted on the rear portion of the accommodating container so that the accommodating container is movable along the guide rail, and a support holder formed on the front portion of the accommodating container to be supported on at least one of the guide rail and the inner wall of the tub.

20 Claims, 24 Drawing Sheets

(56) References Cited

U.S. PATENT DOCUMENTS

| | | | | |
|---|---|---|---|---|
| 4,119,377 | A | 10/1978 | Barber et al. | |
| 5,787,911 | A | 8/1998 | Jacobus et al. | |
| 10,080,478 | B2 | 9/2018 | Jeong et al. | |
| 2001/0044992 | A1 | 11/2001 | Jahrling | |
| 2008/0011337 | A1* | 1/2008 | Ryu | A47L 15/504 134/147 |
| 2018/0160880 | A1* | 6/2018 | Dabade | A47L 15/507 |
| 2018/0206701 | A1* | 7/2018 | Ko | A47L 15/503 |

FOREIGN PATENT DOCUMENTS

| | | | |
|---|---|---|---|
| CN | 103829902 | A | 6/2014 |
| CN | 105640466 | | 6/2016 |
| DE | 20006242 | | 6/2000 |
| EP | 0848930 | | 6/1998 |
| EP | 1323372 | | 7/2003 |
| EP | 3175764 | | 6/2017 |
| KR | 10-1997-0000100 | | 1/1997 |
| KR | 20-0220903 | | 4/2001 |
| KR | 20-0338607 | | 1/2004 |
| KR | 10-2004-0040337 | | 5/2004 |
| KR | 10-2006-0100597 | | 9/2006 |
| KR | 10-2007-0008808 | | 1/2007 |
| KR | 10-2015-0052610 | | 5/2015 |
| KR | 10-2015-0080384 | | 7/2015 |
| KR | 10-2017-0021599 | | 2/2017 |

OTHER PUBLICATIONS

Extended European Search Report dated Jan. 24, 2020 in European Patent Application No. 19182721.1.

European Office Action dated Apr. 5, 2022 in European Patent Application No. 19 182 721.1 (4 pages).

Chinese Office Action dated May 30, 2022 in Chinese Patent Application No. 201910635420.X (6 pages; 9 pages English Translation).

Chinese Office Action dated Nov. 29, 2022 in Chinese Patent Application No. 201910635420.X (5 pp; 7pages English translation).

Indian Office Action dated Jul. 22, 2022 in Indian Patent Application No. 202117007990 (6 pages).

Office Action dated Oct. 13, 2023 in Korean Patent Application No. 10-2018-0162212.

Office Action dated Nov. 8, 2023 in European Patent Application No. 19 182 721.1.

* cited by examiner

DISHWASHER

CROSS-REFERENCE TO RELATED APPLICATIONS

This application is based on and claims priority under 35 U.S.C. § 119 to Korean Patent Application No. 10-2018-0091814, filed on Aug. 7, 2018 and Korean Patent Application No. 10-2018-0162212, filed on Dec. 14, 2018 in the Korean Intellectual Property Office, the disclosures of which are incorporated by reference herein in their entireties.

BACKGROUND

1. Field

The disclosure relates to a dishwasher, and more particularly to a dishwasher having an improved structure to prevent deformation of an accommodating container.

2. Description of the Related Art

A dishwasher is a device that automatically cleans food waste left on tableware using a detergent and washing water.

The dish washer includes a main body, a tub disposed inside the main body, an accommodating container disposed inside the tub to accommodate tableware, and an injection unit provided to inject washing water to the accommodating container.

The accommodating container may be drawn out of or inserted into the tub along guide rails provided on the tub. The draw-out or insertion of the accommodating container may be realized by guide rollers which are rotatably installed along the guide rails.

Generally, the accommodating container is supported by the guide rollers when positioned inside the tub. Because the guide rollers support a rear end portion of the accommodating container, a front end portion of the accommodating container is liable to be deformed in the gravity direction.

When the front end portion of the accommodating container is deformed as described above, it is difficult to expect a smooth draw-out or insertion of the accommodating container. In addition, there may be restrictions on the type of tableware that may be accommodated in the accommodating container. As an example, when the accommodating container includes an upper accommodating container and a lower accommodating container, the distance between the upper accommodating container and the lower accommodating container may be narrowed when the upper accommodating container is deformed. This may lead to a result that the accommodating space of the lower accommodating container is narrowed, and as a result, it may become difficult to accommodate large-sized tableware in the lower accommodating container.

SUMMARY

It is an aspect of the disclosure to provide a dishwasher having an improved structure so as to facilitate the draw-out and insertion of an accommodating container.

It is an aspect of the disclosure to provide a dishwasher having an improved structure so as to improve the space utilization of an accommodating container.

Additional aspects of the disclosure will be set forth in part in the description which follows and, in part, will be obvious from the description, or may be learned by practice of the disclosure.

In accordance with an aspect of the disclosure, a dishwasher includes a main body, a tub provided inside the main body and including an opening, a door provided to open and close the opening of the tub, a guide rail mounted on an inner wall of the tub, an accommodating container provided to accommodate tableware and be movable along the guide rail, and including a front portion facing the opening and a rear portion, at least one roller rotatably mounted on the rear portion of the accommodating container so that the accommodating container is movable along the guide rail, and a support holder formed on the front portion of the accommodating container to be supported on at least one of the guide rail and the inner wall of the tub.

The support holder may extend from the front portion of the accommodating container to be supported on an upper portion of the guide rail.

The guide rail may include a rail body fixed to the inner wall of the tub and including one end facing the opening, and a rail holder coupled to the one end of the rail body and extending downward.

The accommodating container may further include a side wall facing the guide rail, and the support holder may be formed on an upper portion of the side wall of the accommodating container to avoid interference with the rail holder.

The accommodating container may further include a side wall facing the guide rail, and a stopper interfering with the rail holder to restrict the draw-out of the accommodating container may be provided on the side wall of the accommodating container.

The support holder may include a support holder body forming an outer appearance, and the support holder body may include a first wall facing the opening, and a second wall facing the first wall and including a height lower than the first wall in the height direction of the dishwasher.

The at least one roller may include a first roller provided to be supported on an upper portion of the guide rail, and a second roller positioned at a lower side of the guide rail to stably support the accommodating container together with the support holder and the first roller.

The support holder and the first roller may be positioned at an upper side of the guide rail to be spaced apart from each other.

A support portion extending toward the inside of the tub may be formed on the inner wall of the tub to support the support holder.

The accommodating container may further include a side wall facing the guide rail, the support holder includes a support holder body forming an outer appearance, and the support holder body may include a first wall extending from the side wall of the accommodating container to be positioned at an upper side of the guide rail and provided with a support protrusion protruding to contact the guide rail, and a second wall bent downward from the first wall to cover the guide rail together with the first wall.

The guide rail may include one end facing the opening, and a support portion extending toward the inside of the tub may be formed on the one end of the guide rail to support the support holder.

The accommodating container may include a loading portion on which the tableware is placed and a wall disposed along a circumference of the loading portion, and the loading portion and the wall may have a plastic material.

In accordance with an aspect of the disclosure, a dishwasher includes a main body, a tub provided inside the main body and including an opening, a door provided to open and close the opening of the tub, a guide rail mounted on an inner wall of the tub, and including a rail body including one end facing the opening and a rail holder coupled to the one end of the rail body and extending downward, an accommodating container provided to accommodate tableware and be movable along the guide rail, and a support holder provided on the accommodating container to be supported on at least one of the guide rail and the inner wall of the tub and positioned at an upper side of the guide rail to avoid interference with the rail holder.

The accommodating container may include a front portion facing the opening and a rear portion, and the support holder may be provided on the front portion of the accommodating container.

The dishwasher may further include at least one roller mounted on the rear portion of the accommodating container to movably couple the accommodating container to the guide rail.

The support holder may extend from the front portion of the accommodating container to be supported on an upper portion of the guide rail.

The rail body may further include the other end fixed to the inner wall of the tub and positioned at the opposite side of the one end facing the opening, and the guide rail may further include a rail holder coupled to the other end of the rail body and extending upward.

The accommodating container may include a side wall facing the guide rail, and a stopper interfering with the rail holder to restrict the draw-out of the accommodating container may be provided on the side wall of the accommodating container.

The accommodating container may include a loading portion on which the tableware is placed and a wall disposed along a circumference of the loading portion, and the loading portion and the wall may have a plastic material.

In accordance with an aspect of the disclosure, a dishwasher includes a main body, a tub provided inside the main body and including an opening, a door provided to open and close the opening of the tub, a guide rail mounted on an inner wall of the tub, an accommodating container provided to accommodate tableware and be movable along the guide rail, a plurality of rollers rotatably mounted on the accommodating container so that the accommodating container is movable along the guide rail, and including a first roller positioned at an upper side of the guide rail and a second roller positioned at a lower side of the guide rail, and a support holder extending from the accommodating container to be positioned at an upper side of the guide rail, wherein the accommodating container may be supported on at least one of the guide rail and the inner wall of the tub at three points by the first roller, the second roller and the support holder.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
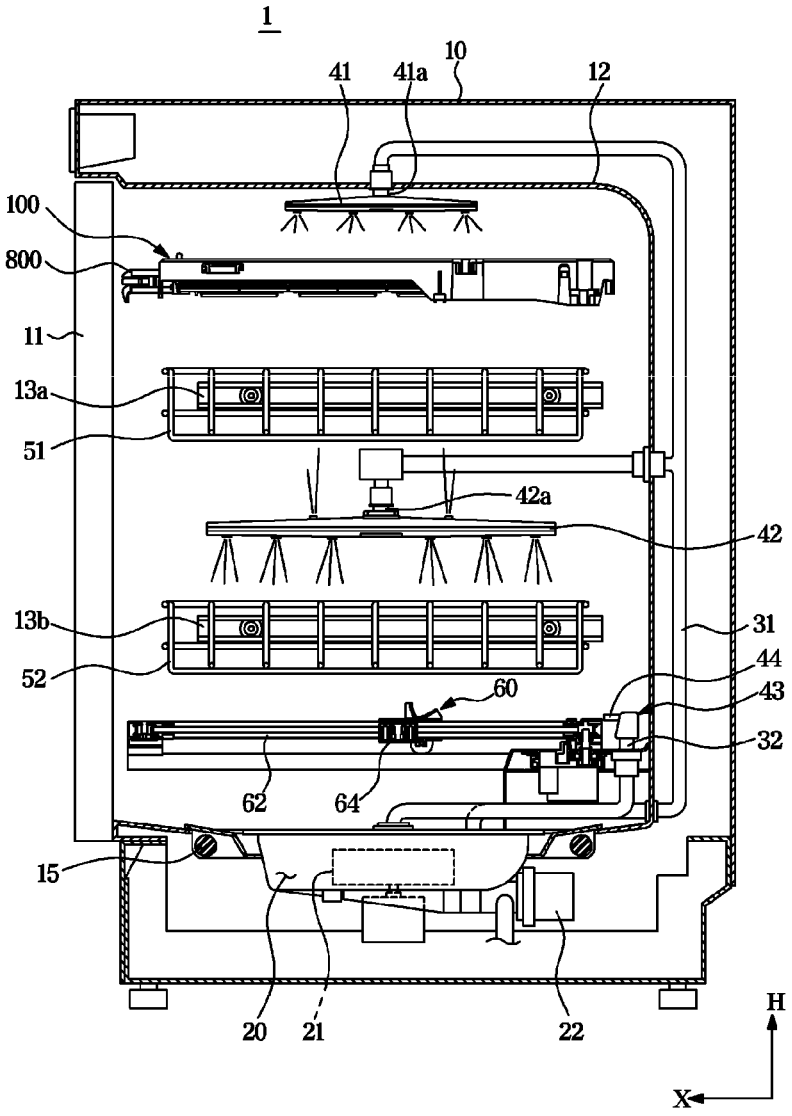
FIG. 1 is a cross-sectional view of a dishwasher according to an embodiment of the disclosure.

Reference will now be made in detail to the embodiments, examples of which are illustrated in the accompanying drawings, wherein like reference numerals refer to like elements throughout. The embodiments are described below to explain the present disclosure by referring to the figures.

Hereinafter, embodiments of the disclosure will be described in detail with reference to the accompanying drawings. The terms "front end", "rear end", "upper portion", "lower portion", "upper end" and "lower end" used in the following description are defined with reference to the drawings, and the shape and position of each component are not limited by these terms.

Hereinafter, tableware may be used as a concept including a bowl, a cup, cutlery, and various cooking utensils.

Hereinafter, "X" indicates the front-rear direction of a dishwasher, "Y" indicates the left-right direction of the dishwasher, and "H" indicates the height direction of the dishwasher.

Figure 2:
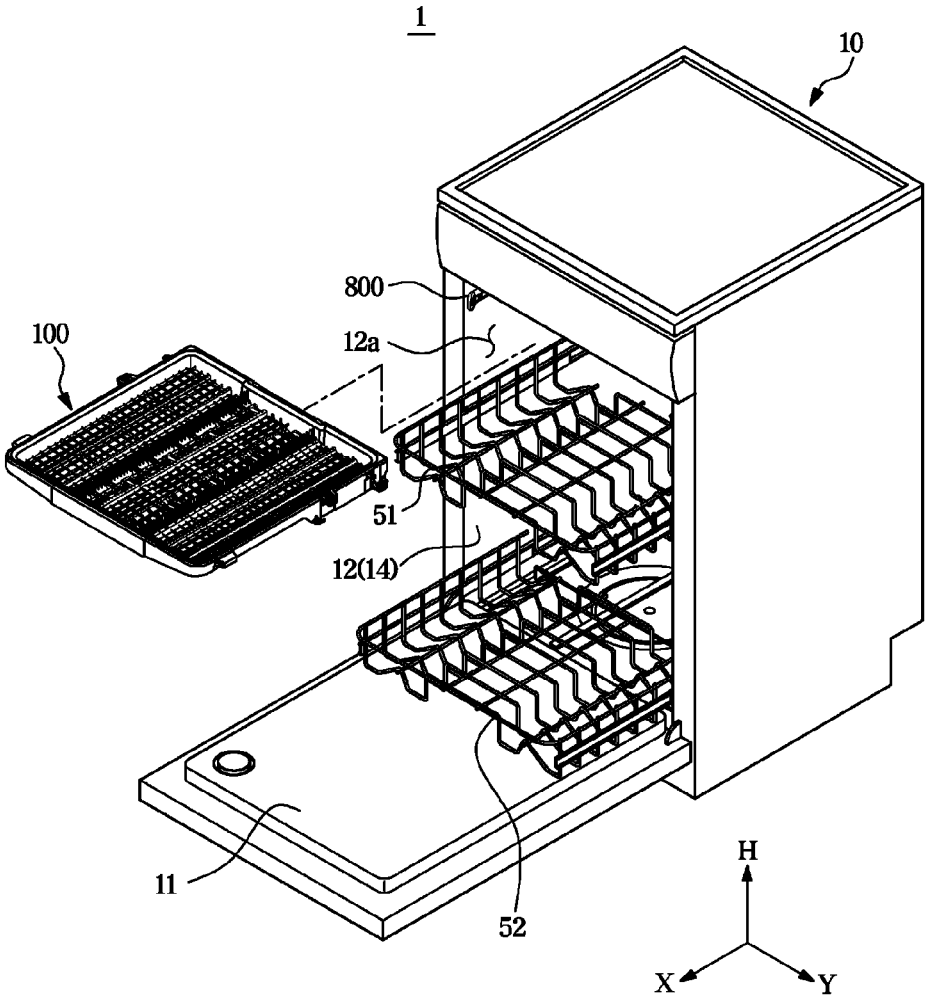
FIG. 2 is a perspective view of the dishwasher according to an embodiment of the disclosure.

FIG. 1 is a cross-sectional view of a dishwasher according to an embodiment of the disclosure, and FIG. 2 is a perspective view of the dishwasher according to an embodiment of the disclosure.

As illustrated in FIGS. 1 and 2, a dishwasher 1 may include a main body 10 forming an outer appearance.

The dishwasher 1 may further include a tub 12 provided inside the main body 10. The tub 12 may be provided in a substantially box shape. One surface of the tub 12 may be opened. That is, the tub 12 may have an opening 12*a*. As an example, the front surface of the tub 12 may be opened.

The dishwasher 1 may further include a door 11 provided to open and close the opening 12*a* of the tub 12. The door 11 may be installed on the main body 10 to open or close the opening 12*a* of the tub 12. The door 11 may be rotatably installed on the main body 10.

The dishwasher 1 may further include an accommodating container provided inside the tub 12 to accommodate tableware.

The accommodating container may include a plurality of baskets 51 and 52. The plurality of baskets 51 and 52 may accommodate relatively large-sized tableware. However, the plurality of baskets 51 and 52 are not limited to accommodating only relatively large-sized tableware. That is, the plurality of baskets 51 and 52 may accommodate not only relatively large-sized tableware but also relatively small-sized tableware.

The plurality of baskets 51 and 52 may include the upper basket 51 positioned at an upper portion of the dishwasher 1 in a height direction H of the dishwasher 1 and the lower basket 52 positioned at a lower portion of the dishwasher 1 in the height direction H of the dishwasher 1. The upper basket 51 may be provided to be supported by an upper guide rack 13*a*, and the lower basket 52 may be provided to be supported by a lower guide rack 13*b*. The upper basket 51 and the lower basket 51 may be mounted on an inner wall 14 of the tub 12 so as to be slidable toward the opening 12*a* of the tub 12. The inner wall 14 of the tub 12 may include an inner surface of the right wall and an inner surface of the left wall of the tub 12.

The accommodating container may further include a rack assembly 100. The rack assembly 100 may be disposed inside the tub 12 to accommodate tableware. Specifically, the rack assembly 100 may be disposed inside the tub 12 to be drawn out of the tub 12. The rack assembly 100 may accommodate relatively small-sized tableware. Particularly, the rack assembly 100 may accommodate cooking utensils such a ladle, a knife and a fritter tender, or cutlery. The rack assembly 100 may also accommodate small cups such as an espresso cup. However, the type of tableware accommodated in the rack assembly 100 is not limited to the above example. The rack assembly 100 may be positioned above the plurality of baskets 51 and 52 in the height direction H of the dishwasher 1. That is, the rack assembly 100 may be positioned at an uppermost portion of the tub 12 in the height direction H of the dishwasher 1. A detailed description of the rack assembly 100 will be given later.

The dishwasher 1 may further include a guide rail 800 that is mounted on the inner wall 14 of the tub 12 to guide the movement of the accommodating container. The accommodating container may be provided to be movable along the guide rail 800. Specifically, the guide rail 800 may be mounted on the inner wall 14 of the tub 12 to guide the movement of the rack assembly 100. Instead of an upper guide rack 13*a* and a lower guide rack 13*b*, the guide rail 800 may also be mounted on the inner wall 14 of the tub 12 to guide the movement of the plurality of baskets 51 and 52. A detailed description of the guide rail 800 will be given later.

The dishwasher 1 may further include a sump 20 to collect and store washing water. The sump 20 may be provided with a washing pump 21 to pump the stored washing water to injection units 41, 42 and 43. The washing water pumped by the washing pump 21 is supplied to the first injection unit 41 and the second injection unit 42 through a first supply pipe 31, which will be described later, or to the third injection unit 43 through a second supply pipe 32, which will be described later.

The dishwasher 1 may further include a heater 15 disposed below the tub 12 to heat the washing water and a drain pump 22 disposed below the tub 12 to drain the washing water.

The dishwasher 1 may further include the injection units 41, 42 and 43 provided to inject the washing water. The injection units 41, 42 and 43 may include the first injection unit 41 disposed above the upper basket 51 in the height direction of the dishwasher 1, the second injection unit 42 disposed between the upper basket 51 and the lower basket 52 in the height direction of the dishwasher 1, and the third injection unit 43 disposed below the lower basket 52 in the height direction of the dishwasher 1. Specifically, the first injection unit 41 may be disposed above the rack assembly 100 in the height direction of the dishwasher 1.

The first injection unit 41 may be provided to be rotatable about a rotation shaft 41*a* and the second injection unit 42 may be provided to be rotatable about a rotation shaft 42*a*.

The first injection unit 41 may inject the washing water toward the tableware accommodated in the rack assembly 100 and the upper basket 51, and the second injection unit 42 may inject the washing water toward the tableware accommodated in the upper basket 51 and the lower basket 52.

The third injection unit 43 may be provided to be fixed to one side of the tub 12, unlike the first injection unit 41 and the second injection unit 42. The third injection unit 43 injects the washing water in a substantially horizontal direction, and therefore, the washing water injected from the third injection unit 43 may be not directly injected to the tableware.

The third injection unit 43 may include nozzles 44 from which the washing water is injected. The nozzles 44 may be arranged in a line so as to be spaced apart from one side to the opposite side of the tub 12 by a predetermined distance.

The washing water injected in the substantially horizontal direction from the nozzles 44 of the third injection unit 43 may be changed in direction by a direction changing assembly 60 disposed inside the tub 12 and directed toward the tableware accommodated in the lower basket 52. The direction changing assembly 60 may be provided to be movable along a guide rail 62 while being constrained to the guide rail 62 by a holder 64.

Figure 3:
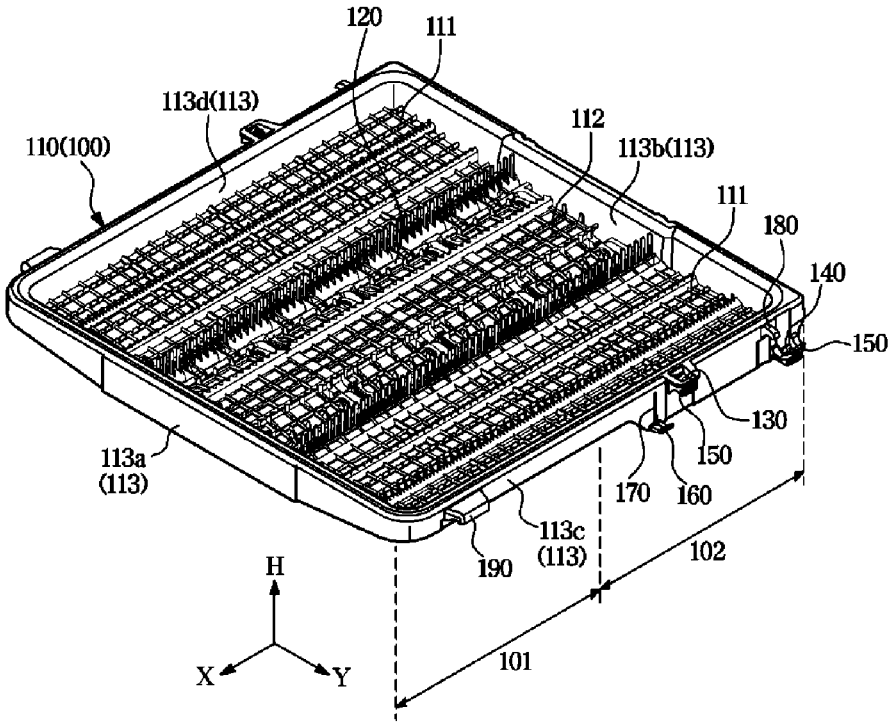
FIG. 3 is a perspective view of a rack assembly according to an embodiment in the dishwasher according to an embodiment of the disclosure.

FIG. 3 is a perspective view of a rack assembly in the dishwasher according to an embodiment of the disclosure.

As illustrated in FIG. 3, the rack assembly 100 may have a substantially rectangular shape. However, the shape of the rack assembly 100 is not limited to the above example and may be variously changed.

The rack assembly 100 may include a frame 110 forming an outer appearance of the rack assembly 100.

The frame 110 may include a loading portion on which tableware is placed. The loading portion may include a fixing plate 111 and a lifting plate 112 provided to be movable up and down. The lifting plate 112 may be provided to be adjustable in height. The lifting plate 112 may be disposed at a central portion of the frame 110 to be movable up and down. The tableware may be placed on the fixing plate 111 and the lifting plate 112.

The frame 110 may further include a wall 113 disposed along a circumference of the loading portion. The wall 113 of the frame 110 may include a first wall 113*a* facing the opening 12*a* of the tub 12, a second wall 113*b* facing the first wall 113*a*, and a third wall 113*c* and a fourth wall 113*d* connecting the first wall 113*a* and the second wall 113*b*. As an example, the first wall 113*a* of the frame 110 may face the front of the tub 12 and the second wall 113*b* of the frame 110 may face the rear wall of the tub 12. The third wall 113*c* and the fourth wall 113*d* of the frame 110 may face the right wall and the left wall of the tub 12, respectively.

The rack assembly 100 may further include an operation member (not shown) provided to adjust the height of the lifting plate 112 and a lifting induction member 120 provided to connect the operation member and the lifting plate 112. The lifting induction member 120 may be provided to be rotatable. The lifting induction member 120 may have a steel material to prevent the frame 110 from being deformed by providing rigidity to the frame 110. As an example, the lifting induction member 120 may include a shaft. The lifting plate 112 may move in conjunction with the lifting induction member 120.

The dishwasher 1 may further include one or more rollers 130 and 140 provided such that the rack assembly 100 is movable along the guide rail 800. The one or more rollers 130 and 140 may be mounted on the frame 110 to be rotatable along the guide rail 800. The one or more rollers 130 and 140 may be provided on the rack assembly 100 to movably couple the rack assembly 100 to the guide rail 800.

A roller mounting portion 150 may be provided on the wall 113 of the rack assembly 100 to accommodate the one or more rollers 130 and 140. The roller mounting portion 150 may be formed integrally with the frame 110 so that the one or more rollers 130 and 140 are mounted therein. Specifically, the roller mounting portion 150 may be injection molded integrally with the fixing plate 111 and the wall 113 so that the one or more rollers 130 and 140 are mounted therein. The roller mounting portion 150 may be formed to protrude from the wall 113 of the frame 110. Specifically, the roller mounting portion 150 may be formed to protrude from the third wall 113*c* and the fourth wall 113*d* of the frame 110 facing the right wall and the left wall of the tub 12.

The one or more rollers 130 and 140 may rotate about roller rotation shafts (not shown). That is, the one or more rollers 130 and 140 may be accommodated inside the roller mounting portion 150 to rotate about the roller rotation shafts. The roller rotation shafts may extend in a left-right direction Y of the dishwasher 1.

The dishwasher 1 may further include a first support holder 190 extending from the rack assembly 100 to be supported by at least one of the guide rail 800 and the inner wall 14 of the tub 12. That is, the first support holder 190 may extend from the wall 113 of the frame 110 facing the inner wall 14 of the tub 12. In other words, the first support holder 190 may extend from the wall 113 of the frame 110 facing the guide rail 800. The first support holder 190 may be positioned at the front of a second support holder 180, which will be described later.

The rack assembly 100 may include a front portion 101 nearest the opening 12*a*, and a rear portion 102. That is, the rack assembly 100 may include the front portion 101 towards the front of the dishwasher 1 and the rear portion 102 towards the rear of the dishwasher 1.

The front portion 101 and the rear portion 102 of the rack assembly 100 will be described below with reference to the wall 113 of the rack assembly 100. The wall 113 of the rack assembly 100 may include the front portion 101 facing the opening 12*a* and the rear portion 102 positioned on the opposite side of the front portion 101. The front portion 101 and the rear portion 102 of the wall 113 may be defined by the center of the wall 113 of the rack assembly 100 extending to the front-rear direction X of the dishwasher 1. That is, the lengths of the front portion 101 and the rear portion 102 may be equal in the front-rear direction X of the dishwasher 1.

The first support holder 190 may be provided at the front portion 101 of the rack assembly 100, and the one or more rollers 130 and 140 may be provided at the rear portion 102 of the rack assembly 100. The second support holder 180, which will be described later, may also be provided at the rear portion 102 of the rack assembly 100. The first support holder 190 may be provided on the same wall 113 as the wall 113 of the frame 110 on which the one or more rollers 130 and 140 are installed. As an example, when the one or more rollers 130 and 140 are installed on the third wall 113*c* of the frame 110 facing the right wall of the tub 12, the first support holder 190 may be provided on the third wall 113*c* of the frame 110.

The first support holder 190 and the one or more rollers 130 and 140 may be disposed to be spaced apart from each other.

The rack assembly 100 may have a plastic material. Specifically, the frame 110 forming the outer appearance of the rack assembly 100 may have a plastic material. More specifically, the loading portion and the wall 113 of the rack assembly 100 may have a plastic material. In an aspect, the frame 110 forming the outer appearance of the rack assembly 100 may be injection molded. Specifically, the loading portion and the wall 113 of the frame 110 may be integrally injection molded. More specifically, the fixing plate 111 and the wall 113 may be integrally injection molded. Also, the roller mounting portion 150 may be injection molded integrally with the fixing plate 111 and the wall 113 of the frame 110.

The first support holder 190 may be injection molded integrally with the fixing plate 111, the wall 113 and the roller mounting portion 150. However, it is sufficient if the first support holder 190 is provided on the wall 113 of the frame 110 facing the inner wall 14 of the tub 12, and the method of forming the first support holder 190 is not limited to the above example. As an example, the first support holder 190 may be provided in a configuration separate from the frame 110 and coupled to the wall 113 of the frame 110 facing the inner wall 14 of the tub 12.

Particularly, the first support holder 190 may have the same material as the frame 110. However, the material of the first support holder 190 is not limited to the above example and may be variously changed. That is, the first support holder 190 may have a material different from that of the frame 110.

Because the rack assembly 100 of the disclosure uses the frame 110 formed of only plastic instead of using the metal wire frame, a rack assembly that is relatively light and low in manufacturing cost may be realized. Further, because the rack assembly 100 of the disclosure may be integrally manufactured by injection molding the frame 110 forming the external appearance, the conventional process of coupling an accommodating container to a metal wire frame may be omitted. Therefore, the manufacturing process of the rack assembly 100 of the disclosure may be simple compared to the manufacturing process of the conventional rack assembly.

The rack assembly 100 may further include stoppers 160 and 170 provided to restrict the draw-out of the rack assembly 100. The stoppers 160 and 170 may be formed at the wall 113 of the frame 110 facing the inner wall 14 of the tub 12. The stoppers 160 and 170 may be formed integrally with the wall 113 of the frame 110. The stoppers 160 and 170 may be positioned between the first support holder 190 and the one or more rollers 130 and 140. The stoppers 160 and 170 may prevent the rack assembly 100 from being excessively drawn out of the tub 12 through interference with the guide rail 800. Specifically, the stoppers 160 and 170 may prevent the rack assembly 100 from being excessively drawn out of the tub 12 through interference with a first rail holder 820 (refer to FIG. 5) of the guide rail 800.

The stoppers 160 and 170 may protrude from the wall 113 of the frame 110 facing the inner wall 14 of the tub 12 toward the inner wall 14 of the tub 12.

The stoppers 160 and 170 may include the first stopper 160 protruding from the wall 113 of the frame 110 to be positioned below the guide rail 800.

The stoppers 160 and 170 may further include the second stopper 170 extending along the wall 113 of the frame 110 in the height direction H of the dishwasher 1.

The first and second stoppers 160 and 170 may be formed to be adjacent to each other. The first stopper 160 may be positioned below the second stopper 170.

Particularly, the rack assembly 100 may include at least one of the first stopper 160 and the second stopper 170.

The rack assembly 100 may further include the second support holder 180 provided to be supported on the guide rail 800. The front portion 102 of the rack assembly 100 may be supported on the guide rail 800 by the one or more rollers 130 and 140 and the second support holder 180. The second support holder 180 may be formed at the wall 113 of the frame 110 facing the inner wall 14 of the tub 12. The second support holder 180 may be formed integrally with the wall 113 of the frame 110. The second support holder 180 may extend from the wall 113 of the frame 110 to be supported on an upper portion of the guide rail 800. That is, the second support holder 180 may extend from the wall 113 of the frame 110 to be supported on the upper portion of the guide rail 800.

Figure 4A:
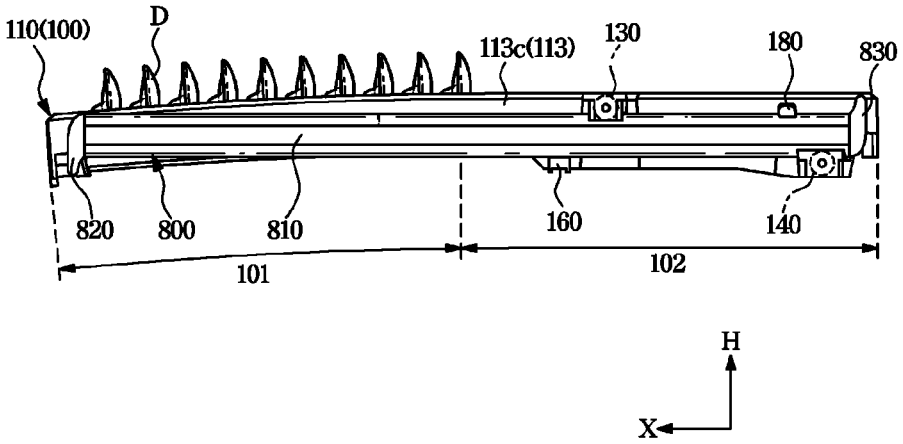
FIGS. 4A and 4B are views illustrating a case where a support holder is not installed and a case where a support holder is installed on the rack assembly, respectively, in the dishwasher according to an embodiment of the disclosure.
Figure 4B:
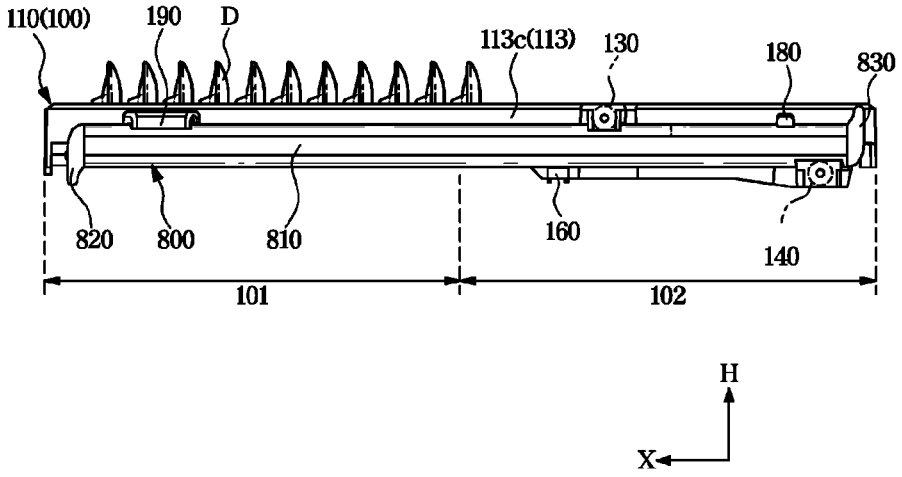

FIGS. 4A and 4B are views illustrating a case where a support holder is not installed and a case where a support holder is installed on the rack assembly, respectively, in the dishwasher according to an embodiment of the disclosure. "D" in FIGS. 4A and 4B indicates a tableware. FIGS. 4A and 4B illustrate spoons as an example of the tableware.

As illustrated in FIG. 4A, when the first support holder 190 is not installed on the rack assembly 100, the rack assembly 100 may be bent or sagged in the gravity direction by the load of the rack assembly 100 itself and the load of the tableware D accommodated in the rack assembly 100. In particular, the deformation of the front portion 101 of the rack assembly 100 may be more severe. This is because the rear portion 102 of the rack assembly 100 may be supported on the guide rail 800 by the one or more rollers 130 and 140 and the second support holder 180, while a separate support structure is not applied to the front portion 101 of the rack assembly 100.

As illustrated in FIG. 4B, when the first support holder 190 is installed on the rack assembly 100, the deformation of the rack assembly 100, and in particular, the deformation of the front portion 101 of the rack assembly 100 may be effectively prevented. This is because the front portion 101 of the rack assembly 100 may be supported on at least one of the guide rail 800 and the inner wall 14 of the tub 12 by the first support holder 190 and the rear portion 102 of the rack assembly 100 may be supported on the guide rail 800 by the one or more rollers 130 and 140 and the second support holder 180. As such, by simultaneously supporting the front portion 101 and the rear portion 102 of the rack assembly 100, the stress concentrated on one portion of the rack assembly 100 is dispersed throughout the rack assembly 100, so that the deformation of the rack assembly 100 may be effectively prevented.

In an aspect, when the first support holder 190 is installed on the rack assembly 100, the rack assembly 100 may be supported on at least one of the guide rail 800 and the inner walls 14 of the tub 12 at three points by the first roller 130, the second roller 140 and the first support holder 190. As such, when the rack assembly 100 may be supported at three points by the first roller 130, the second roller 140 and the first support holder 190, the rack assembly 100 may be stably supported on at least one of the guide rail 800 and the inner walls 14 of the tub 12. In particular, the front portion 101 of the rack assembly 100 may be supported by the first support holder 190 and the rear portion 102 of the rack assembly 100 may be supported by the first roller 130 and the second roller 140 facing each other, so that the deformation of the front portion 101 of the rack assembly 100 may be effectively prevented as illustrated in FIG. 4A.

The rack assembly 100 may also be supported on at least one of the guide rail 800 and the inner walls 14 of the tub 12 at four points by the first roller 130, the second roller 140, the first support holder 190 and the second support holder 180.

The number of points on which the rack assembly 100 is supported is not limited to the above example and may be variously changed.

Figure 5:
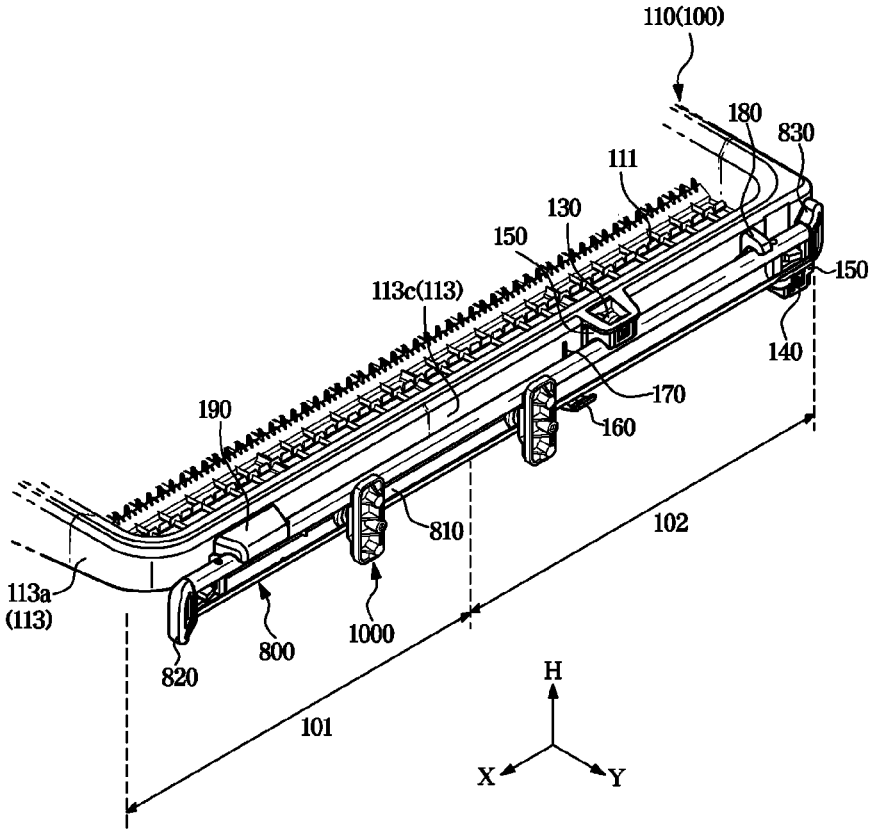
FIG. 5 is a perspective view of the rack assembly before being drawn out of a tub in the dishwasher according to an embodiment of the disclosure.
Figure 6:
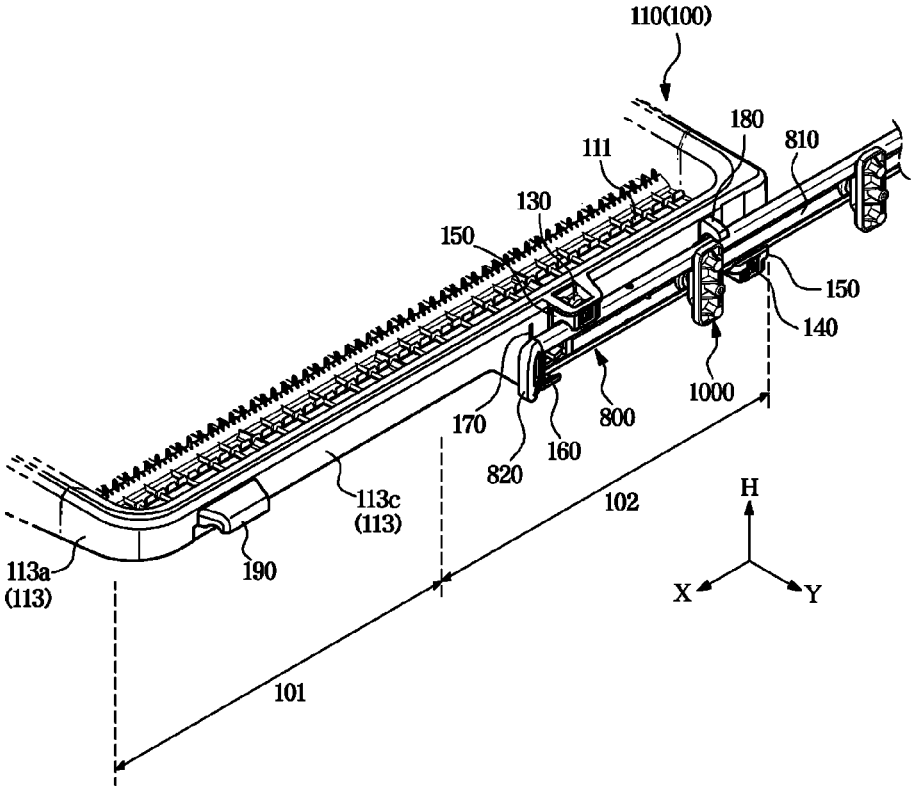
FIG. 6 is a perspective view of the rack assembly drawn out of the tub in the dishwasher according to an embodiment of the disclosure.

FIG. 5 is a perspective view of the rack assembly before being drawn out of the tub in the dishwasher according to an embodiment of the disclosure, and FIG. 6 is a perspective view of the rack assembly drawn out of the tub in the dishwasher according to an embodiment of the disclosure.

As illustrated in FIGS. 5 and 6, the rack assembly 100 is slidably movable along the guide rail 800. That is, the rack assembly 100 may be drawn out of the tub 12 or inserted into the tub 12 along the guide rail 800.

As illustrated in FIG. 5, the rack assembly 100 may be positioned inside the tub 12 in a state of being supported on the guide rail 800. The front portion 101 of the rack assembly 100 may be supported on the guide rail 800 by the first support holder 190. The rear portion 102 of the rack assembly 100 may be supported on the guide rail 800 by the one or more rollers 130 and 140 and the second support holder 180.

The first support holder 190 may extend from the wall 113 of the frame 110 to be supported on an upper portion of the guide rail 800. That is, the first support holder 190 may extend from the wall 113 of the frame 110 to be hung on or cover the upper portion of the guide rail 800.

The first support holder 190 may be formed at an upper end portion of the wall 113 of the frame 110.

The guide rail 800 may include a rail body 810. The rail body 810 may be fixed to the inner wall 14 of the tub 12. Specifically, the rail body 810 may be fixed to the inner wall 14 of the tub 12 by a coupling member 1100 (refer to FIG. 9) via a mounting member 1000. The coupling member 1100 may include a screw. The rail body 810 may include a first end nearest to the opening 12*a* and a second end positioned on the opposite side of the first end. That is, the first end of the rail body 810 may face the front of the dishwasher 1 and the second end of the rail body 810 may face the rear of the dishwasher 1.

The guide rail 800 may include rail holders 820 and 830 coupled to the rail body 810. The rail holders 820 and 830 may include the first rail holder 820 coupled to the first end of the rail body 810 and the second rail holder 830 coupled to the second end of the rail body 810.

The first rail holder 820 and the second rail holder 830 may extend toward directions different from each other. Specifically, the first rail holder 820 may extend downward to avoid the interference with the first support holder 190 and the second rail holder 830 may extend upward. That is, the first rail holder 820 may be bent downward to prevent the movement of the rack assembly 100 from being restricted by the interference with the first support holder 190 and the second rail holder 830 may be bent upward. However, the extending direction or the bending direction of the first rail holder 820 and the second rail holder 830 is not limited to the above example. That is, the first rail holder 820 and the second rail holder 830 may extend or bend toward the same direction.

As illustrated in FIG. 6, the draw-out of the rack assembly 100 may be restricted by the interference with the first rail holder 820 and the stoppers 160 and 170. That is, the rack assembly 100 may be drawn out of the tub 12 until the rack assembly 100 is interfered by the first rail holder 820 and the stoppers 160 and 170.

When the rack assembly 100 is drawn out of the tub 12, the front portion 101 of the rack assembly 100 may be in a free state. That is, when the rack assembly 100 is drawn out of the tub 12, the coupling of the first support holder 190 and the guide rail 800 is released, and as a result, the front portion 101 of the rack assembly 100 may be in a free state that is not supported by the guide rail 800. When the rack assembly 100 is drawn out of the tub 12, the rear portion 102 of the rack assembly 100 may be supported on the guide rail 800 by the one or more rollers 130 and 140 and the second support holder 180.

As illustrated in FIGS. 5 and 6, the one or more rollers 130 and 140 may include the first roller 130 and the second roller 140 facing each other with the guide rail 800 interposed therebetween. The first roller 130 may be positioned on an upper portion of the guide rail 800 to rotate along an upper surface of the guide rail 800 and the second roller 140 may be positioned on a lower portion of the guide rail 800 to rotate along a lower surface of the guide rail 800. The first roller 130 may be positioned at the front of the second roller 140 in the front-rear direction X of the dishwasher 1.

The first support holder 190 may be positioned on the same side as one of the first roller 130 and the second roller 140 about the guide rail 800. Specifically, the first support holder 190 may be positioned on the same side as the first roller 130 about the guide rail 800 to be supported on the upper portion of the guide rail 800. That is, the first support holder 190 and the first roller 130 may be positioned on the upper portion of the guide rail 800.

Figure 7:
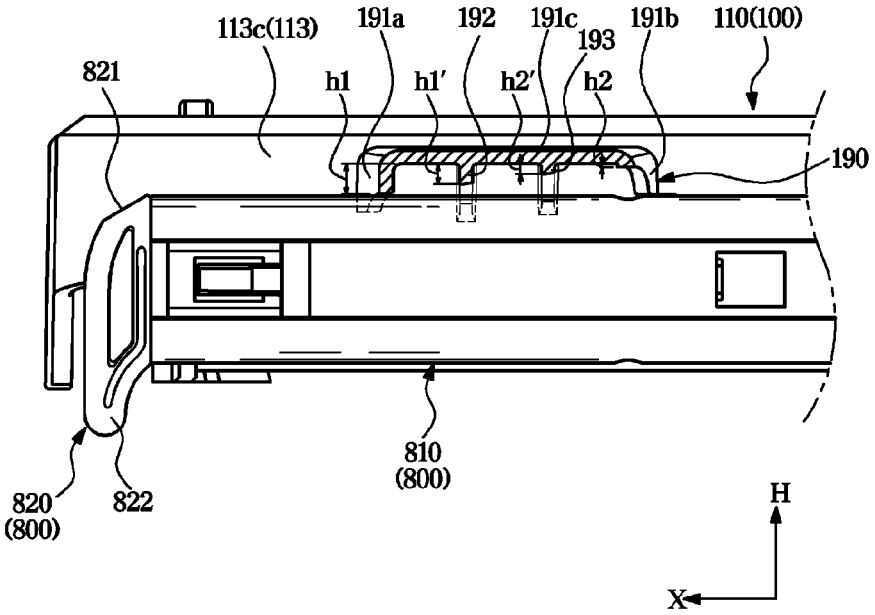
FIG. 7 is a view illustrating a relationship between the rack assembly and a guide rail when the rack assembly is inside the tub in the dishwasher according to an embodiment of the disclosure.
Figure 8:
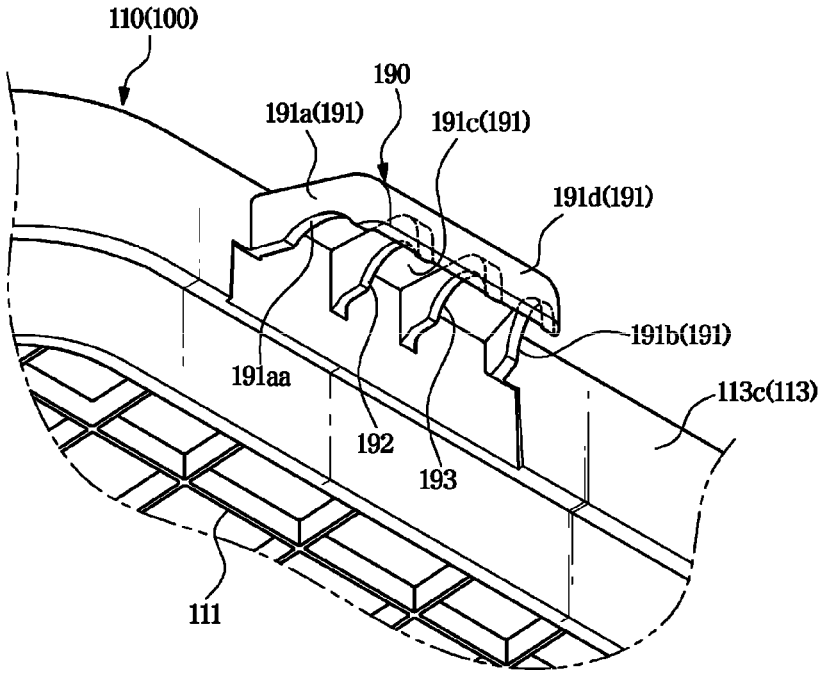
FIG. 8 is a bottom perspective view of the rack assembly for showing an inner structure of a support holder of the rack assembly in the dishwasher according to an embodiment of the disclosure.

FIG. 7 is a view illustrating a relationship between the rack assembly and a guide rail when the rack assembly is inside the tub in the dishwasher according to an embodiment of the disclosure, and FIG. 8 is a bottom perspective view of the rack assembly showing an inner structure of a support holder of the rack assembly in the dishwasher according to an embodiment of the disclosure.

As illustrated in FIGS. 7 and 8, the first rail holder 820 may include an upper surface 821 extending in the upward direction of the dishwasher 1. The upper surface 821 of the first rail holder 820 may be inclined to guide the movement of the rack assembly 100. The upper surface 821 of the first rail holder 820 may be inclined upward toward the opposite side of the opening 12*a*. That is, the upper surface 821 of the first rail holder 820 may be inclined upward toward the rear of the dishwasher 1. The rack assembly 100 may be easily drawn out of or inserted into the tub 12 along the guide rail 800 through the inclined structure of the first rail holder 820.

The first rail holder 820 may further include a hook portion 822. The hook portion 822 may restrict the draw-out of the rack assembly 100 by the interference with the first stopper 160. The second stopper 170 may restrict the draw-out of the rack assembly 100 by the interference with an inner side surface (not shown) of the first rail holder 820 facing the wall 113 of the frame 110.

The first support holder 190 may have a shape corresponding to the first rail holder 820. Specifically, the first support holder 190 may have a shape corresponding to the upper surface 821 of the first rail holder 820.

The first support holder 190 may include a support holder body 191 forming an outer appearance thereof. The support holder body 191 may extend from the wall 113 of the frame 110 to face the inner wall 14 of the tub 12. The support holder body 191 may include a first wall 191*a* nearest to the opening 12*a* and a second wall 191*b* facing the first wall 191*a*. The second wall 191*b* may have a lower height than the first wall 191*a* in the height direction H of the dishwasher 1. That is, a height h1 of the first wall 191*a* may be higher than a height h2 of the second wall 191*b* in the height direction H of the dishwasher 1.

The support holder body 191 may further include a third wall 191*c* that extends in the upward direction of the dishwasher 1 and connects the first wall 191*a* and the second wall 191*b*. The third wall 191*c* may be positioned at an upper side of the guide rail 800 to cover an upper portion of the guide rail 800.

The support holder body 191 may further include a fourth wall 191*d* that is connected to the first wall 191*a*, the second wall 191*b* and the third wall 191*c* and bent downward from the third wall 191*c*. The fourth wall 191*d* of the support holder body 191 may face the inner wall 14 of the tub 12.

The first support holder 190 may further include one or more protruding ribs 192 and 193 formed inside the support holder body 191. The one or more protruding ribs 192 and 193 may extend downward from the third wall 191*c* of the support holder body 191. The heights of the one or more protruding ribs 192 and 193 may be lower than that of the first wall 191*a* of the support holder body 191 and higher than that of the second wall 191*b* of the support holder body 191 in the height direction H of the dishwasher 1. As an example, when the one or more protruding ribs 192 and 193 include the first protruding rib 192 adjacent to the first wall 191*a* and the second protruding rib 193 adjacent to the second wall 191*b*, a height h1' of the first protruding rib 192 may be lower than the height h1 of the first wall 191*a* and higher than a height h2' of the second protruding rib 193. The height h2' of the second protruding rib 193 may be higher than the height h2 of the second wall 191*b* and lower than the height h1' of the first protruding rib 192.

The heights of the first wall 191*a*, the one or more protruding ribs 192 and 193, and the second wall 191*b* may gradually decrease toward the rear of the dishwasher 1.

The heights of the first wall 191*a*, the second wall 191*b*, and the one or more protruding ribs 192 and 193 may be defined as the distances between the portions where the first wall 191*a*, the second wall 191*b*, and the one or more protruding ribs 192 and 193 are supported by the guide rail 800 and the third wall 191*c*. In an aspect, the heights of the first wall 191*a*, the second wall 191*b*, and the one or more protruding ribs 192 and 193 may be defined as the lowest heights of the first wall 191*a*, the second wall 191*b*, and the one or more protruding ribs 192 and 193 with reference to the third wall 191*c*.

As illustrated in FIG. 7, when the rack assembly 100 is positioned inside the tub 12, the rack assembly 100 may be supported on the rail body 810 of the guide rail 800 by the first support holder 190. At this time, the first wall 191*a* of the first support holder 190 may be supported by direct contact with the rail body 810. Specifically, the first wall 191*a* of the first support holder 190 may be supported by direct contact with an upper surface of the rail body 810.

Figure 9:
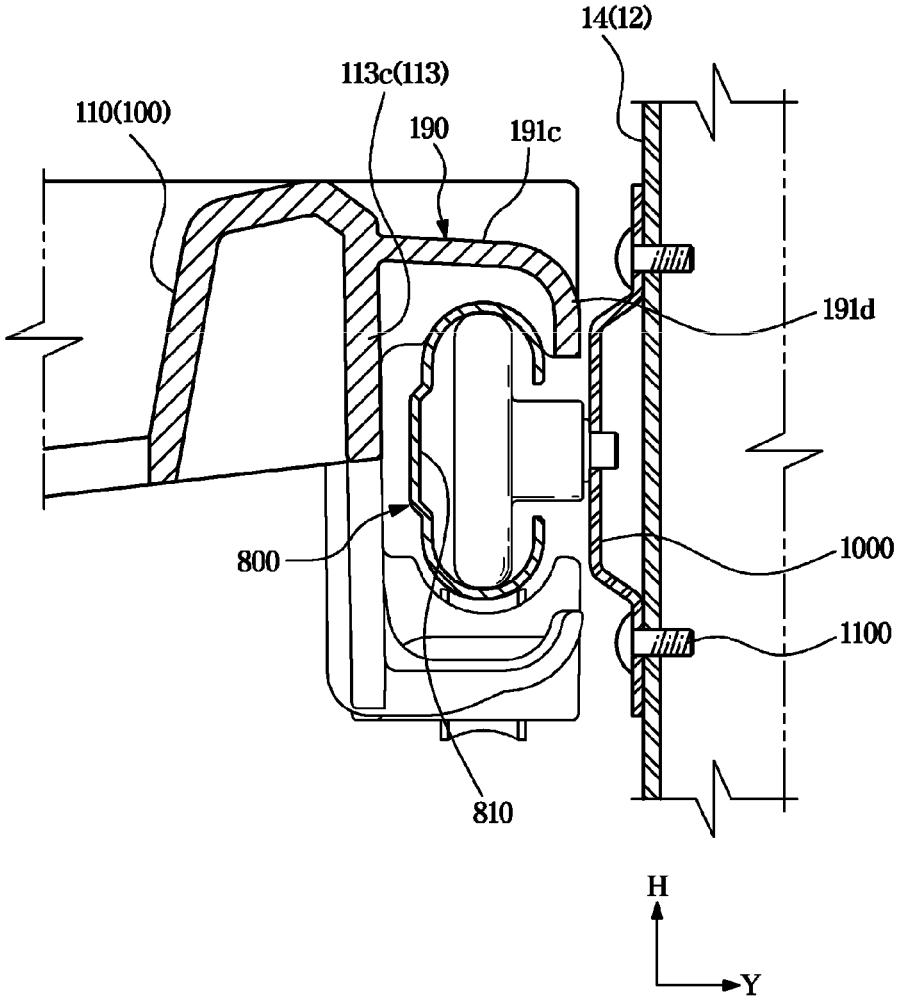
FIG. 9 is a cross-sectional view illustrating a state in which the support holder of the rack assembly is mounted on the guide rail in the dishwasher according to an embodiment of the disclosure.

FIG. 9 is a cross-sectional view illustrating a state in which the support holder of the rack assembly is mounted on the guide rail in the dishwasher according to an embodiment of the disclosure.

As illustrated in FIG. 9, when positioned inside the tub 12, the rack assembly 100 may be supported on the guide rail 800 by the first support holder 190. Specifically, when positioned inside the tub 12, the rack assembly 100 may be supported on the rail body 810 of the guide rail 800 by the first support holder 190.

When the front portion 101 of the rack assembly 100 is supported on the guide rail 800 by the first support holder 190, the third wall 191*c* of the support holder body 191 may be positioned at an upper side of the guide rail 800, and the fourth wall 191*d* of the support holder body 191 may be positioned between the guide rail 800 and the inner wall 14 of the tub 12 by being bent from the third wall 191*c* to surround the guide rail 800.

When the front portion 101 of the rack assembly 100 is supported on the guide rail 800 by the first support holder 190, the third wall 191*c* of the support holder body 191 may be spaced apart from the guide rail 800. The front portion 101 of the rack assembly 100 may be supported on the guide rail 800 substantially by the first wall 191*a* of the support holder body 191. Specifically, the front portion 101 of the rack assembly 100 may be supported on the guide rail 800 by fitting a groove 191*aa* (refer to FIG. 8) formed at the first wall 191*a* of the support holder body 191 into the guide rail 800. However, the method of supporting the front portion 101 of the rack assembly 100 is not limited to the above example. As an example, the front portion 101 of the rack assembly 100 may be supported on the guide rail 800 by at least one of the first wall 191*a*, the second wall 191*b*, and the one or more protruding ribs 192 and 193.

Figure 10:
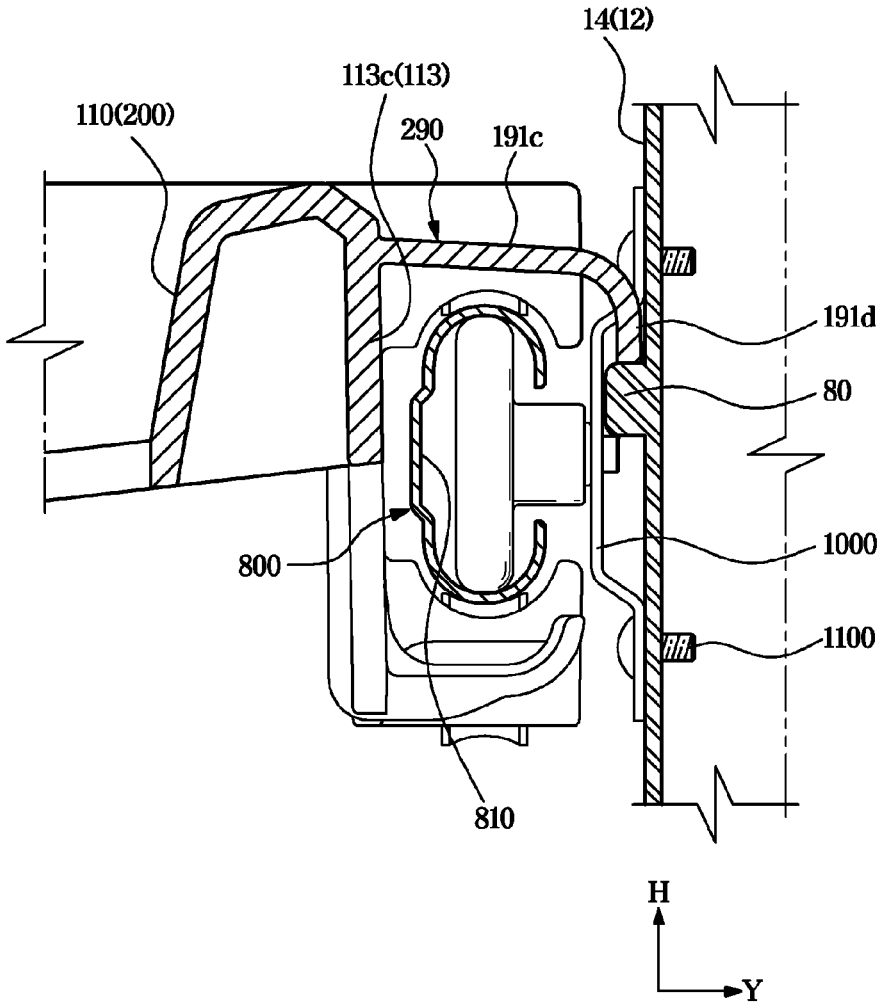
FIG. 10 is a cross-sectional view illustrating a state in which a support holder of a rack assembly is mounted on an inner wall of a tub in the dishwasher according to an embodiment of the disclosure.

FIG. 10 is a cross-sectional view illustrating a state in which a support holder of the rack assembly is mounted on an inner wall of a tub in a dishwasher according to an embodiment of the disclosure. Hereinafter, a description overlapping with the first support holder 190 of the rack assembly 100 will be omitted.

As illustrated in FIG. 10, a rack assembly 200 may be supported on the inner wall 14 of the tub 12 by a support holder 290. That is, the front portion 101 of the rack assembly 200 may be supported on the inner wall 14 of the tub 12 by the support holder 290.

A support portion 80 extending toward the inside of the tub 12 to support the support holder 290 may be formed at the inner wall 14 of the tub 12. As an example, the support portion 80 may have a protrusion shape protruding toward the inside of the tub 12. However, it is sufficient if the support portion 80 may support the support holder 290 and the shape thereof may be variously changed.

The support holder 290 may be supported on the support portion 80 of the tub 12 by extending from the wall 113 of the frame 110 facing the inner wall 14 of the tub 12 to surround an upper portion of the guide rail 800.

When the front portion 101 of the rack assembly 200 is supported on the support portion 80 of the tub 12 by the support holder 290, the third wall 191*c* of the support holder body 191 may be positioned at an upper side of the guide rail 800, and the fourth 191*d* of the support holder body 191 may be supported on the support portion 80 of the tub 12 by being bent from the third wall 191*c* to surround the guide rail 800. That is, the fourth 191*d* of the support holder body 191 may be seated on an upper surface of the support portion 80.

When the front portion 101 of the rack assembly 200 is supported on the support portion 80 of the tub 12 by the support holder 290, the third wall 191*c* of the support holder body 191 may be spaced apart from the guide rail 800. The front portion 101 of the rack assembly 200 may be supported on the support portion 80 of the tub 12 substantially by the fourth wall 191*d* of the support holder body 191.

Figure 11:
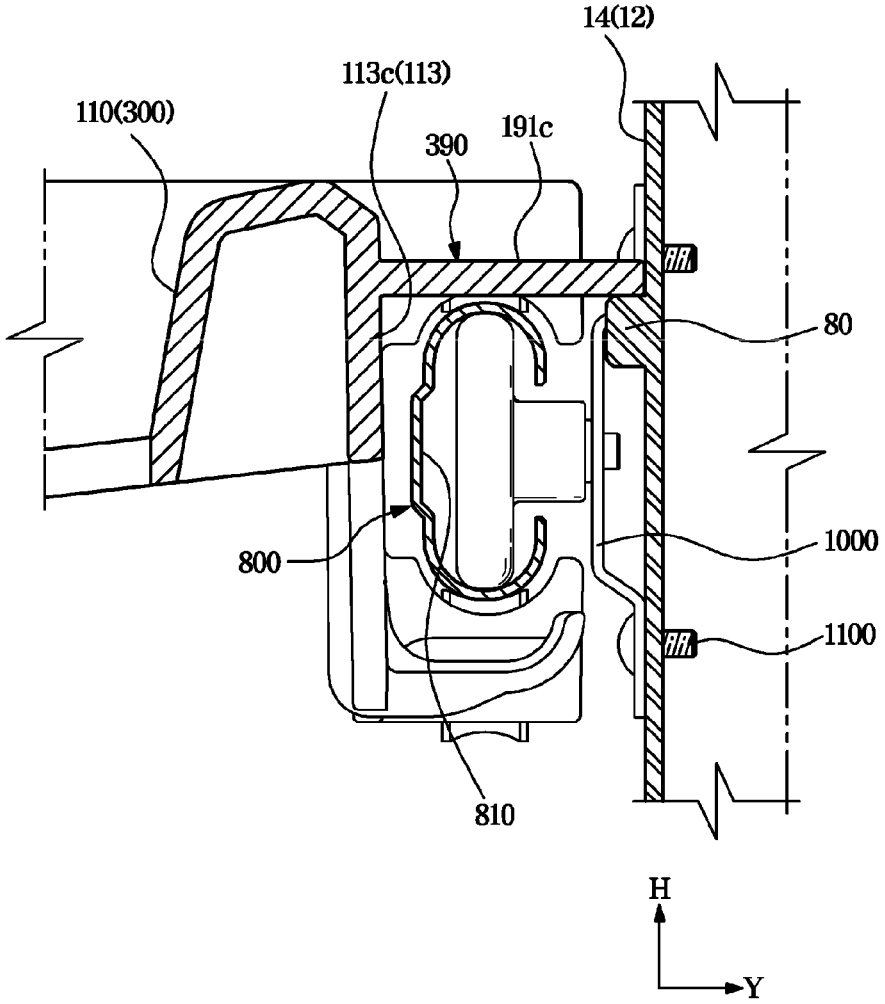
FIG. 11 is a cross-sectional view illustrating a state in which a support holder of a rack assembly is mounted on an inner wall of a tub in the dishwasher according to an embodiment of the disclosure.

FIG. 11 is a cross-sectional view illustrating a state in which a support holder of a rack assembly is mounted on an inner wall of a tub in the dishwasher according to an embodiment of the disclosure. Hereinafter, a description overlapping with the first support holder 190 of the rack assembly 100 will be omitted.

As illustrated in FIG. 11, a rack assembly 300 may be supported on the inner wall 14 of the tub 12 by a support holder 390. That is, the front portion 101 of the rack assembly 300 may be supported on the inner wall 14 of the tub 12 by the support holder 390.

The support portion 80 extending toward the inside of the tub 12 to support the support holder 390 may be formed at the inner wall 14 of the tub 12. As an example, the support portion 80 may have a protrusion shape protruding toward the inside of the tub 12. However, it is sufficient if the support portion 80 may support the support holder 390 and the shape thereof may be variously changed.

The support holder 390 may be supported on the support portion 80 of the tub 12 by extending from the wall 113 of the frame 110 facing the inner wall 14 of the tub 12 to surround an upper portion of the guide rail 800.

The support holder 390 of the rack assembly 300 may have a different structure from the first support holder 190 of the rack assembly 100. Specifically, the support holder body 191 of the support holder 390 of the rack assembly 300 does not include the fourth wall 119*d*.

The third wall 119*c* of the support holder body 191 of the support holder 390 may elongate from the wall 113 of the frame 110 toward the inner wall 14 of the tub 12. The third wall 119*c* of the support holder body 191 may be supported on the support portion 80 of the tub 12 by extending from the wall 113 of the frame 110 facing the inner wall 14 of the tub 12 to cover the upper portion of the guide rail 800. The third wall 119*c* of the support holder body 191 may be linear.

When the front portion 101 of the rack assembly 300 is supported on the support portion 80 of the tub 12 by the support holder 390, the third wall 191*c* of the support holder body 191 may be spaced apart from the guide rail 800. Also, the third wall 191*c* of the support holder body 191 may be seated on the upper surface of the support portion 80.

As such, the front portion 101 of the rack assembly 300 may be supported on the support portion 80 of the tub 12 by the third wall 191*c* of the support holder body 191.

Figure 12:
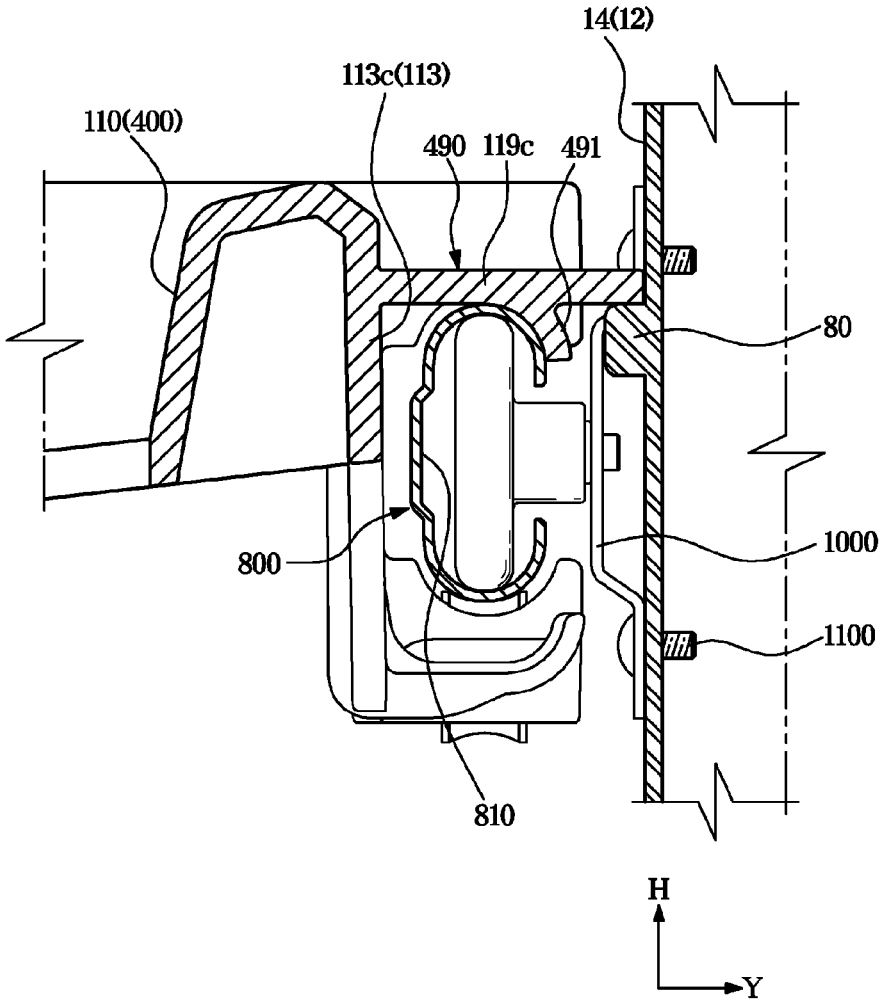
FIG. 12 is a cross-sectional view illustrating a state in which a support holder of a rack assembly is mounted on a guide rail and an inner wall of a tub in the dishwasher according to an embodiment of the disclosure.

FIG. 12 is a cross-sectional view illustrating a state in which a support holder of a rack assembly is mounted on a guide rail and an inner wall of a tub in the dishwasher according to an embodiment of the disclosure. Hereinafter, a description overlapping with the first support holder 190 of the rack assembly 100 will be omitted.

As illustrated in FIG. 12, a rack assembly 400 may be supported on the guide rail 800 and the inner wall 14 of the tub 12 by a support holder 490. That is, the front portion 101 of the rack assembly 400 may be supported on the guide rail 800 and the inner wall 14 of the tub 12 by the support holder 490.

The support portion 80 extending toward the inside of the tub 12 to support the support holder 490 may be formed at the inner wall 14 of the tub 12. As an example, the support portion 80 may have a protrusion shape protruding toward the inside of the tub 12. However, it is sufficient if the support portion 80 may support the support holder 490 and the shape thereof may be variously changed.

The support holder 490 of the rack assembly 400 may have a different structure from the first support holder 190 of the rack assembly 100. Specifically, the support holder body 191 of the support holder 490 of the rack assembly 400 does not include the fourth wall 119*d*. Also, the support holder body 191 of the support holder 490 of the rack assembly 400 may further include a branched wall 491 branched from the third wall 119*c*.

The third wall 119*c* of the support holder body 191 may elongate from the wall 113 of the frame 110 toward the inner wall 14 of the tub 12. The third wall 119*c* of the support holder body 191 may be supported on the support portion 80 of the tub 12 by extending from the wall 113 of the frame 110 facing the inner wall 14 of the tub 12 to cover an upper portion of the guide rail 800. The third wall 119*c* of the support holder body 191 may be linear.

The branched wall 491 of the support holder body 191 may be branched downward from the third wall 119*c*. The branched wall 491 of the support holder body 191 may be supported on the guide rail 800 to surround the upper portion of the guide rail 800.

When the front portion 101 of the rack assembly 300 is supported on the guide rail 800 and the support portion 80 of the tub 12 by the support holder 490, the third wall 191*c* of the support holder body 191 may be seated on the upper surface of the support portion 80 of the tub 12, and the branched wall 491 of the support holder body 191 may be seated on the upper surface of the guide rail 800.

As such, the front portion 101 of the rack assembly 400 may be supported on the support portion 80 of the tub 12 by the third wall 191*c* of the support holder body 191 and supported on the guide rail 800 by the branched wall 491 of the support holder body 191.

Figure 13:
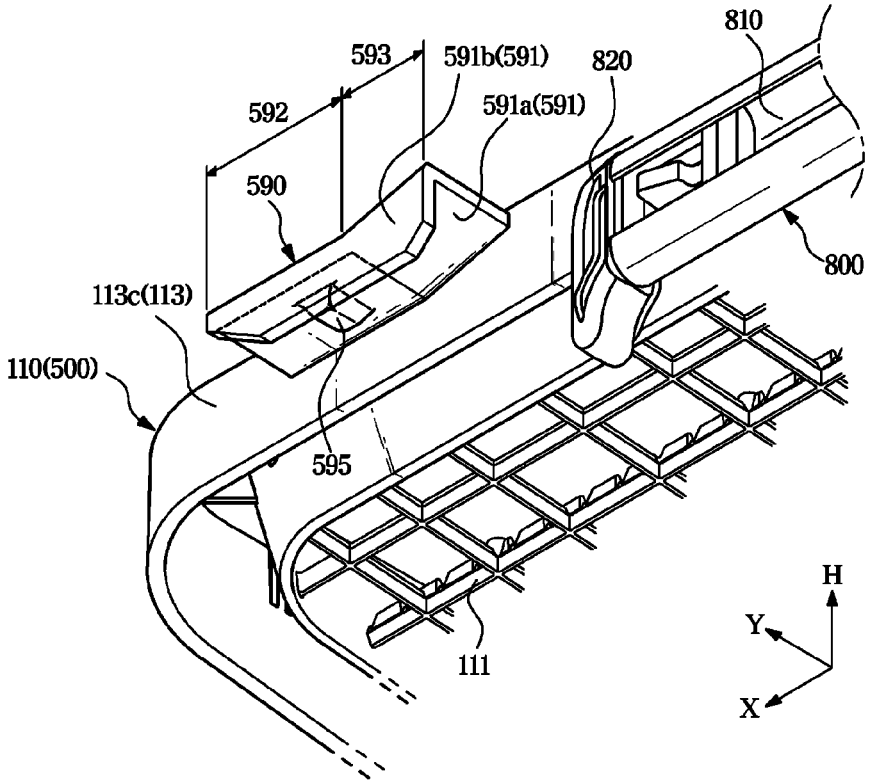
FIG. 13 is a cross-sectional view illustrating a state in which a support holder of a rack assembly is mounted on a guide rail in the dishwasher according to an embodiment of the disclosure.
Figure 14:
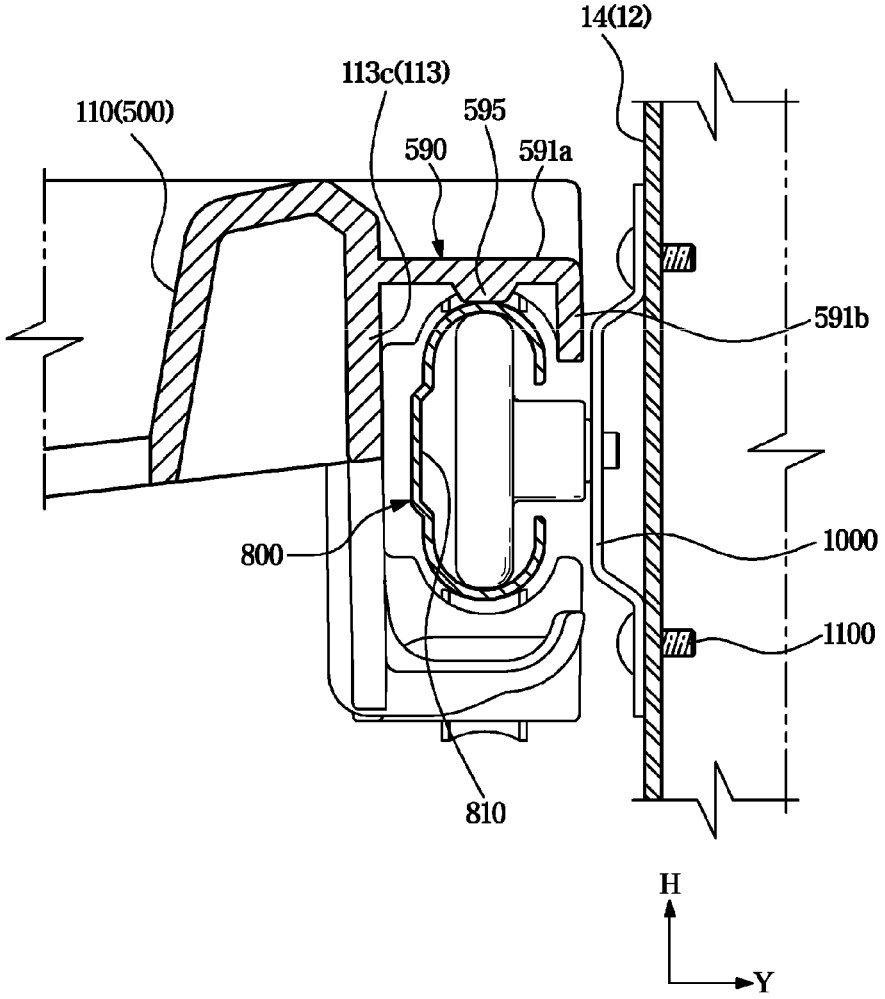
FIG. 14 is a cross-sectional view of FIG. 13.

FIG. 13 is a cross-sectional view illustrating a state in which a support holder of a rack assembly is mounted on a guide rail in the dishwasher according to an embodiment of the disclosure, and FIG. 14 is a cross-sectional view of FIG. 13. Hereinafter, a description overlapping with the first support holder 190 of the rack assembly 100 will be omitted.

As illustrated in FIGS. 13 and 14, a rack assembly 500 may be supported on the guide rail 800 by a support holder 590. That is, the front portion 101 of the rack assembly 500 may be supported on the guide rail 800 by the support holder 590.

The support holder 590 of the rack assembly 500 may have a different structure from the first support holder 190 of the rack assembly 100. Hereinafter, a structure of the support holder 590 of the rack assembly 500 will be described.

The support holder 590 may include a support holder body 591 forming an outer appearance thereof. The support holder body 591 may extend from the wall 113 of the frame 110 to face the inner wall 14 of the tub 12. The support holder body 591 may include a first wall 591*a* extending from the wall 113 of the frame 110 to be positioned at an upper side of the guide rail 800 and a second wall 591*b* provided to cover the guide rail 800 together with the first wall 591*a*. The second wall 591*b* may be bent downward from the first wall 591*a* to cover the guide rail 800 together with the first wall 591*a*.

The support holder 590 may have a shape corresponding to that of the first rail holder 820. Specifically, the support holder 590 may have a shape corresponding to that of the upper surface 821 of the first rail holder 820. The first wall 591*a* of the support holder body 591 may include an inclined structure corresponding to the inclined structure of the first rail holder 820. Specifically, the first wall 591*a* of the support holder body 591 may include a first portion 592 nearest the opening 12*a* and a second portion 593 extending from the first portion 592 to be inclined upward. The rack assembly 500 may be easily inserted into and drawn out of the tub 12 along the guide rail 800 by the inclined structures of the first rail holder 820 and the first wall 591*a* of the support holder body 591.

The first wall 591*a* of the support holder body 591 may be provided with a support protrusion 595 protruding to contact the guide rail 800. The support protrusion 595 may protrude from the first wall 591*a* of the support holder body 591 to contact the upper surface of the guide rail 800. The support protrusion 595 may be formed integrally with the first wall 591*a*. The support protrusion 595 may be provided separately from the first wall 591*a* of the support holder body 591 and coupled to the first wall 591*a* of the support holder body 591.

The support protrusion 595 may be formed at an inner surface of the first wall 591*a* of the support holder body 591 facing the guide rail 800. Particularly, the support protrusion 595 may be formed at the first portion 592 of the first wall 591*a* of the support holder body 591.

When the front portion 101 of the rack assembly 500 is supported on the guide rail 800 by the support holder 590, the support protrusion 595 may be seated on the upper surface of the guide rail 800.

As such, the front portion 101 of the rack assembly 500 may be supported on the guide rail 800 by the support protrusion 595 of the support holder 590.

Figure 15:
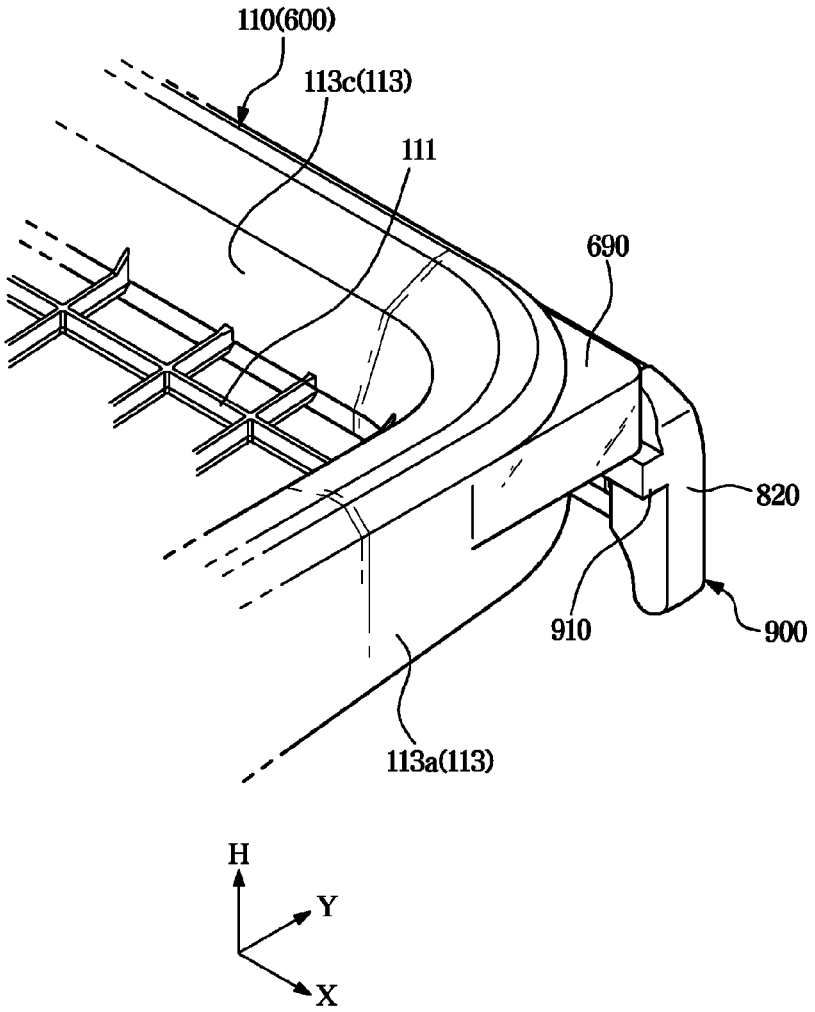
FIG. 15 is a cross-sectional view illustrating a state in which a support holder of a rack assembly is mounted on a guide rail in the dishwasher according to an embodiment of the disclosure.
Figure 16:
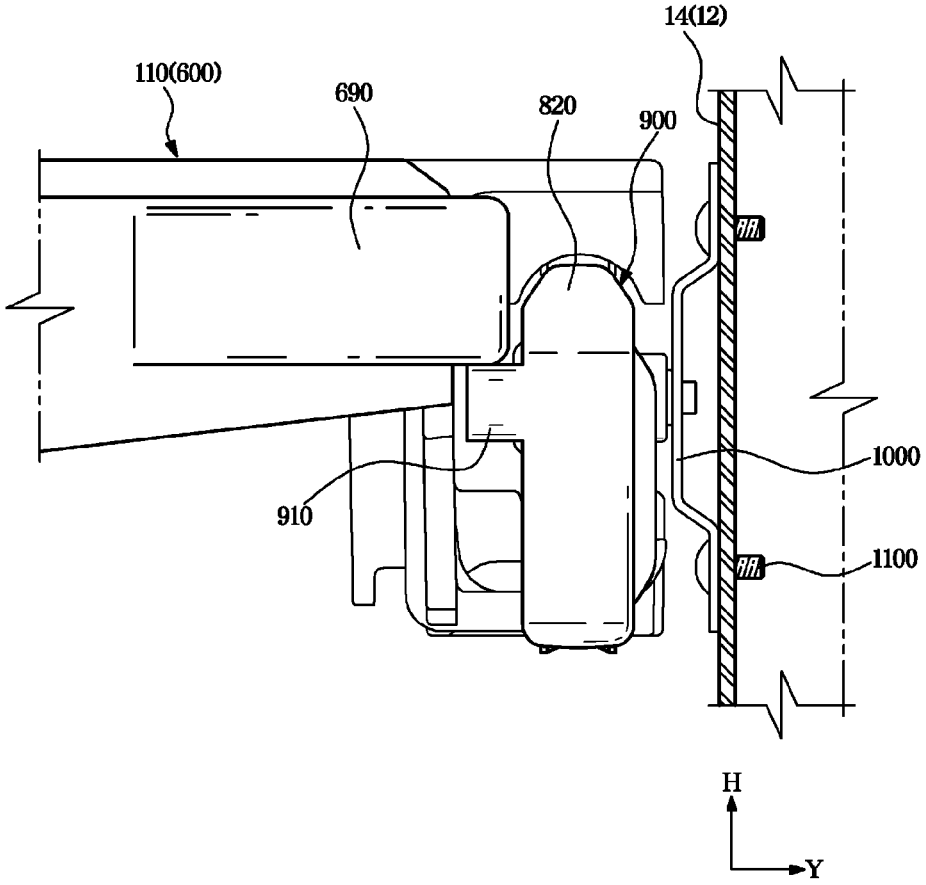
FIG. 16 is a cross-sectional view of FIG. 15.

FIG. 15 is a cross-sectional view illustrating a state in which a support holder of a rack assembly is mounted on a guide rail in the dishwasher according to an embodiment of the disclosure, and FIG. 16 is a cross-sectional view of FIG. 15. Hereinafter, a description overlapping with the first support holder 190 of the rack assembly 100 will be omitted.

As illustrated in FIGS. 15 and 16, a rack assembly 600 may be supported on a guide rail 900 by a support holder 690. That is, the front portion 101 of the rack assembly 600 may be supported on the guide rail 900 by the support holder 690.

The support holder 690 of the rack assembly 600 may have a different structure from the first support holder 190 of the rack assembly 100. Hereinafter, a structure of the support holder 690 of the rack assembly 600 will be described.

The support holder 690 may extend from the wall 113 of the frame 110 to be supported on the guide rail 900. As an example, the support holder 690 may be formed at an edge of the frame 110 so as to protrude outwardly of the frame 110. However, it is sufficient if the support holder 690 may be supported on the guide rail 900 and the position thereof is not limited to the above example. The support holder 690 may be formed at the wall 113 of the frame 110 facing the inner wall 14 of the tub 12 or formed at the wall 113 of the frame 110 facing the opening 12*a*.

The rack assembly 600 may be supported on a support portion 910 of the guide rail 900 by the support holder 690. The support portion 910 may be formed at one end of the guide rail 900 nearest the opening 12*a*. Specifically, the support portion 910 may extend from the guide rail 900 toward the inside of the tub 12. That is, the support portion 910 may extend from the guide rail 900 to face the rack assembly 600. More specifically, the support portion 910 may be formed at the first rail holder 820 so that the support holder 690 may be supported.

The support portion 910 may be formed integrally with the first rail holder 820. The support portion 910 may be provided separately from the first rail holder 820 and coupled to the first rail holder 820.

When the front portion 101 of the rack assembly 600 is supported on the guide rail 900 by the support holder 690, the support holder 690 may be seated on an upper surface of the support portion 910.

As such, the front portion 101 of the rack assembly 600 may be supported on the support portion 910 of the guide rail 900 by the support holder 690.

Figure 17:
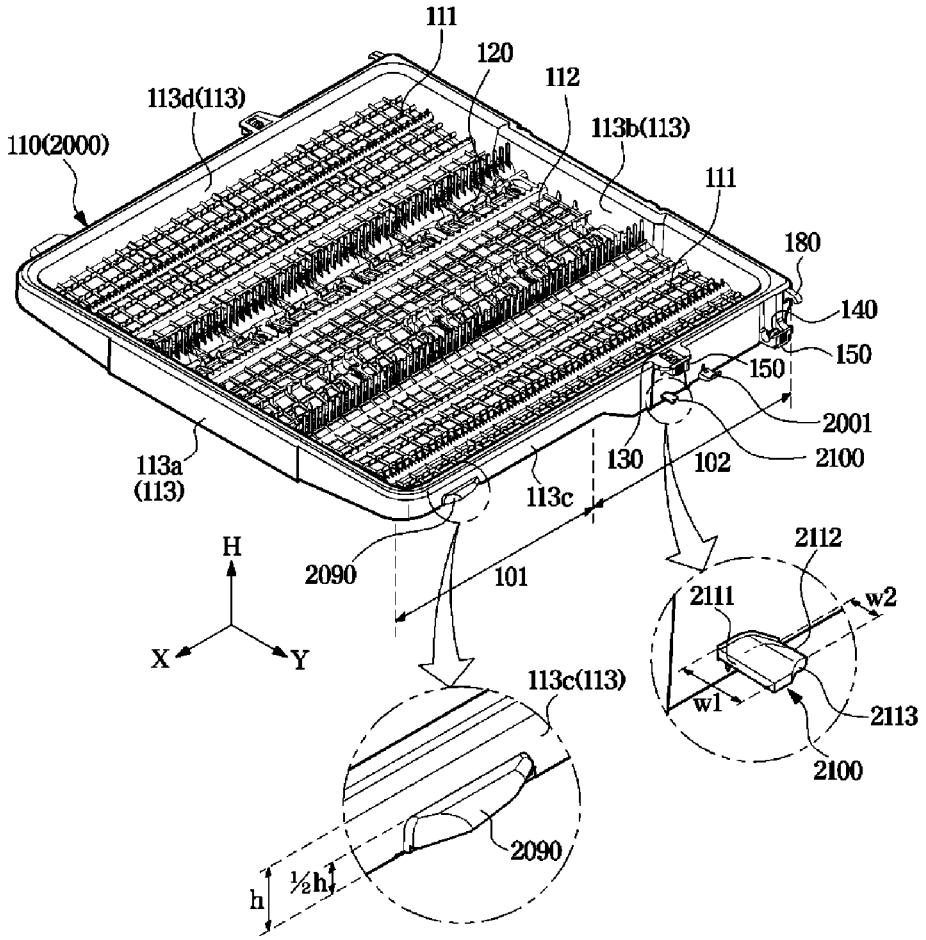
FIG. 17 is a perspective view of a rack assembly in the dishwasher according to an embodiment of the disclosure.

FIG. 17 is a perspective view of a rack assembly in the dishwasher according to an embodiment of the disclosure. Hereinafter, a description overlapping with the rack assembly 100 will be omitted.

As illustrated in FIG. 17, a rack assembly 2000 may have a substantially rectangular shape. However, the shape of the rack assembly 2000 is not limited to the above example and may be variously changed.

The rack assembly 2000 may include the frame 110 forming an outer appearance of the rack assembly 2000.

The frame 110 may include the loading portion on which tableware is placed. The loading portion may include the fixing plate 111 and the lifting plate 112 provided to be movable up and down.

The frame 110 may further include the wall 113 disposed along a circumference of the loading portion. The wall 113 of the frame 110 may include the first wall 113*a* facing the opening 12*a* of the tub 12, the second wall 113*b* facing the first wall 113*a*, and the third wall 113*c* and the fourth wall 113*d* connecting the first wall 113*a* and the second wall 113*b*. As an example, the first wall 113*a* of the frame 110 may face the front of the tub 12 and the second wall 113*b* of the frame 110 may face the rear wall of the tub 12. The third wall 113*c* and the fourth wall 113*d* of the frame 110 may face the right wall and the left wall of the tub 12, respectively.

The rack assembly 2000 may further include an operation member (not shown) provided to adjust the height of the lifting plate 112 and the lifting induction member 120 provided to connect the operation member and the lifting plate 112.

The dishwasher 1 may further include the one or more rollers 130 and 140 provided such that the rack assembly 2000 is movable along the guide rail 800. The one or more rollers 130 and 140 may be mounted on the frame 110 to be rotatable along the guide rail 800. The one or more rollers 130 and 140 may be provided on the rack assembly 2000 to movably couple the rack assembly 2000 to the guide rail 800.

The roller mounting portion 150 may be provided on the wall 113 of the rack assembly 2000 to accommodate the one or more rollers 130 and 140.

The dishwasher 1 may further include a first support holder 2090 extending from the rack assembly 2000 to be supported on at least one of the guide rail 800 and the inner wall 14 of the tub 12. Particularly, the first support holder 2090 may extend from the rack assembly 2000 to be supported on the guide rail 800. That is, the first support holder 2090 may extend from the wall 113 of the frame 110 facing the inner wall 14 of the tub 12. In other words, the first support holder 2090 may extend from the wall 113 of the frame 110 facing the guide rail 800. The first support holder 2090 may be positioned at the front of the second support holder 180.

Figure 19:
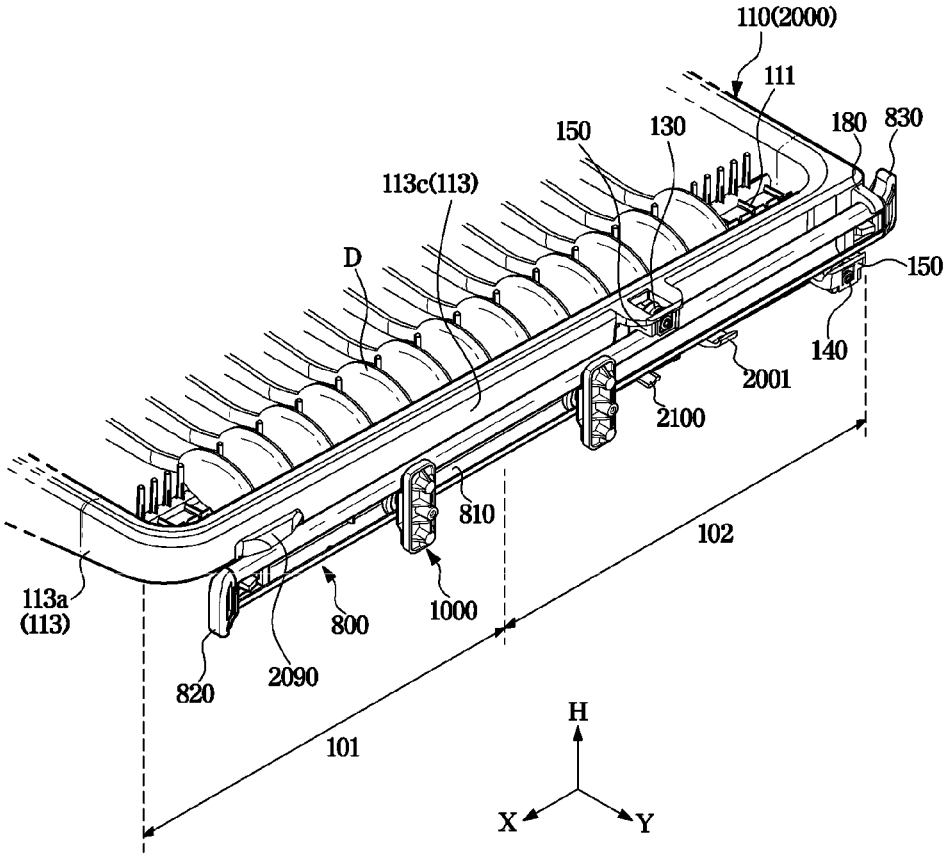
FIG. 19 is a perspective view of the rack assembly before being drawn out of a tub in the dishwasher according to an embodiment of the disclosure.

The first support holder 2090 may be positioned at an upper side of the guide rail 800 (refer to FIG. 19). Specifically, the first support holder 2090 may be positioned at an upper side of the guide rail 800 so that the first support holder 2090 is spaced apart from the guide rail 800 when tableware is not accommodated in the loading portion of the rack assembly 2000.

The first support holder 2090 may be provided to be supported on at least one of the guide rail 800 and the inner wall 14 of the tub 12 when a load is applied to the rack assembly 2000, that is, when tableware is accommodated in the loading portion of the rack assembly 2000.

The first support holder 2090 may be formed at a position corresponding to approximately half of the height of the wall 113 of the frame 110 facing the guide rail 800. Specifically, when the height of the wall 113 of the frame 110 facing the guide rail 800 and extending in the height direction H of the dishwasher 1 is defined as "h", the first support holder 2090 may be formed at a position corresponding to approximately ½ h of the height of the wall 113 of the frame 110. In an aspect, when the height of the wall 113 of the frame 110 facing the guide rail 800 and extending in the height direction H of the dishwasher 1 is defined as "h", the wall 113 of the frame 110 may include an upper portion positioned at an upper side thereof and a lower portion positioned at a lower side thereof with respect to a position corresponding to half of the height of the wall 113 of the frame 110. Particularly, the first support holder 2090 may be formed at the wall 113 of the frame 110 facing the guide rail 800 so as to be adjacent to the boundary between the upper and lower portions of the wall 113 of the frame 110 facing the guide rail 800. However, it is sufficient if the first support holder 2090 is formed to be supported on at least one of the guide rail 800 and the inner wall 14 of the tub 12, and the position where the first support holder 2090 is formed is not limited to the above example. As an example, the first support holder 2090 may be formed at the upper portion of the wall 113 of the frame 110 facing the guide rail 800 so as to be adjacent to the upper end of the wall 113 of the frame 110 facing the guide rail 800 in the same manner as the first support holder 190 of the rack assembly 100.

The rack assembly 2000 may further include a stopper 2100 provided to restrict the draw-out of the rack assembly 2000. The stopper 2100 may be formed at the wall 113 of the frame 110 facing the inner wall 14 of the tub 12. The stopper 2100 may be formed integrally with the wall 113 of the frame 110. The stopper 2100 may prevent the rack assembly 2000 from being excessively drawn out of the tub 12 through interference with the guide rail 800. Specifically, the stopper 2100 may prevent the rack assembly 2000 from being excessively drawn out of the tub 12 through interference with the first rail holder 820 of the guide rail 800.

The stopper 2100 may protrude from the wall 113 of the frame 110 facing the inner wall 14 of the tub 12 toward the inner wall 14 of the tub 12. The stopper 2100 may protrude from the wall 113 of the frame 110 to be positioned below the guide rail 800. The stopper 2100 may be formed integrally with the wall 113 of the frame 110.

The stopper 2100 may include a first end 2111 facing the front of the tub 12 and a second end 2112 facing the rear of the tub 12. The first end 2111 and the second end 2112 may be positioned to have different heights in the height direction H of the dishwasher 1. Specifically, the first end 2111 may be positioned above the second end 2112 in the height direction H of the dishwasher 1.

The first end 2111 and the second end 2112 of the stopper 2100 may have different widths in the left-right direction Y of the dishwasher 1. Specifically, a width w1 of the first end 2111 may be wider than a width w2 of the second end 2112.

The stopper 2100 may further include a connection portion 2113 to connect the first end 2111 and the second end 2112. The connection portion 2113 may be provided to face the inner wall 14 of the tub 12. The connection portion 2113 may contact the first rail holder 820 of the guide rail 800 in the process of coupling the rack assembly 2000 to the guide rail 800. Specifically, the connection portion 2113 of the stopper 2100 may contact one surface of the first rail holder 820 of the guide rail 800 facing the rack assembly 2000 in the process of coupling the rack assembly 2000 to the guide rail 800.

The rack assembly 2000 may further include the second support holder 180 provided to be supported on the guide rail 800.

The rack assembly 2000 may further include a deviation preventing rib 2001 provided to prevent the rack assembly 2000 from being deviated from the guide rail 800. The rack assembly 2000 may be deviated from the guide rail 800 by shaking or the like during the movement along the guide rail 800. The deviation preventing rib 2001 may prevent the rack assembly 2000 from being deviated from the guide rail 800 through interference with the guide rail 800. The deviation preventing rib 2001 may be formed on the wall 113 of the frame 110 facing the inner wall 14 of the tub 12. The deviation preventing rib 2001 may be formed integrally with the wall 113 of the frame 110. The deviation preventing rib 2001 may protrude from the wall 113 of the frame 110 facing the inner wall 14 of the tub 12 toward the inner wall 14 of the tub 12. The deviation preventing rib 2001 may protrude from the wall 113 of the frame 110 to be positioned at a lower side of the guide rail 800. The deviation preventing rib 2001 may be positioned at the rear of the stopper 2100. In an aspect, the deviation preventing rib 2001 may be positioned between the first roller 130 and the second roller 140.

FIGS. 18A to 18D illustrate a process in which the rack assembly is coupled to a guide rail in the dishwasher according to an embodiment of the disclosure.

As illustrated in FIGS. 18A to 18D, the rack assembly 2000 may be movably coupled to the guide rail 800.

The guide rail 800 may have a shape in which a part of the surface facing the inner wall 14 of the tub 12 is open. As an example, the guide rail 800 may have a C-shaped cross-section in which a part of the surface facing the inner wall 14 of the tub 12 is open. The guide rail 800 having a shape as above may have a strong bending strength and a weak twisting strength. Thus, the guide rail 800 may be easily twisted with respect to an imaginary line extending in the longitudinal direction of the guide rail 800 while not easily bent. The guide rail 800 may be elastically deformed. Therefore, the guide rail 800 may be twisted in the process of coupling the rack assembly 2000 to the guide rail 800 and then returned to its original state when the coupling of the rack assembly 2000 to the guide rail 800 is completed.

Hereinafter, the coupling process of the rack assembly 2000 and the guide rail 800 will be described in detail.

Figure 18A:
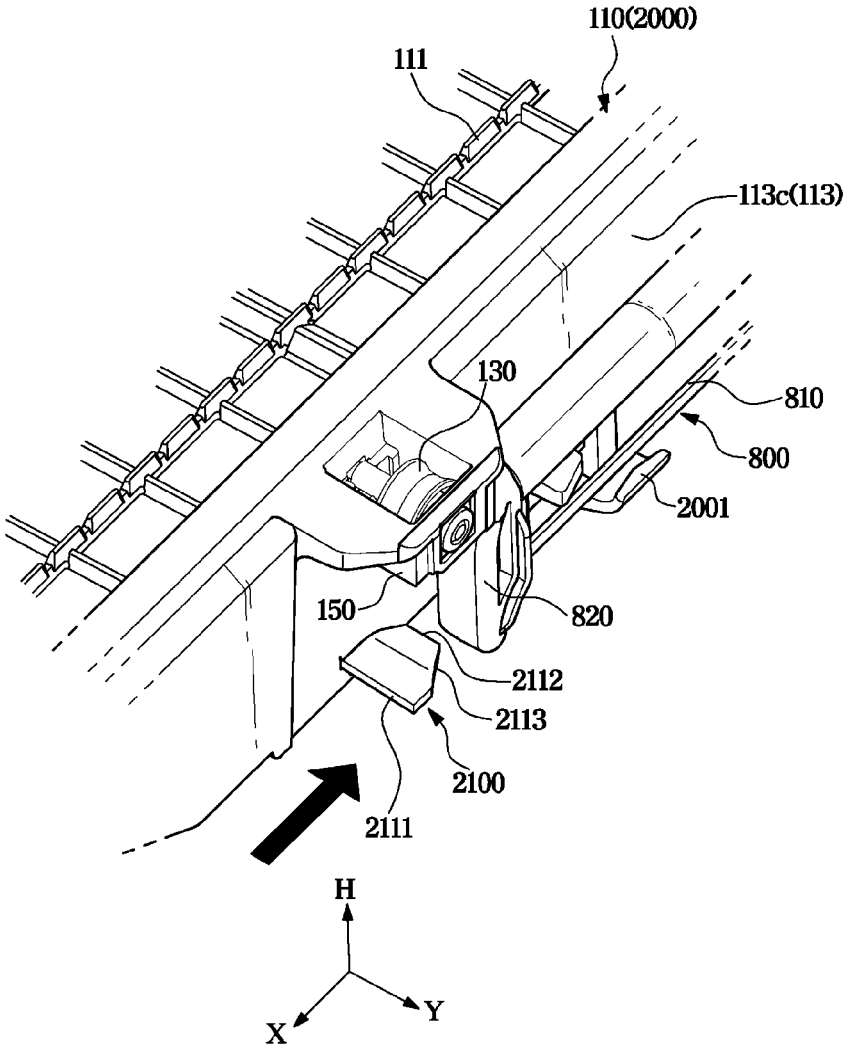
FIGS. 18A, 18B, 18C, and 18D illustrate a process in which the rack assembly is coupled to a guide rail in the dishwasher according to an embodiment of the disclosure.

As illustrated in FIG. 18A, the rack assembly 2000 may be coupled to the guide rail 800 such that the guide rail 800 is positioned between the second support holder 180 and the second roller 140. The rack assembly 2000 may be pushed toward the rear wall of the tub 12 in a state which the rear portion 102 of the rack assembly 2000 is coupled to the guide rail 800.

The stopper 2100 of the rack assembly 2000 may approach the first rail holder 820 of the guide rail 800 as the rack assembly 2000 moves toward the rear wall of the tub 12.

Figure 18B:
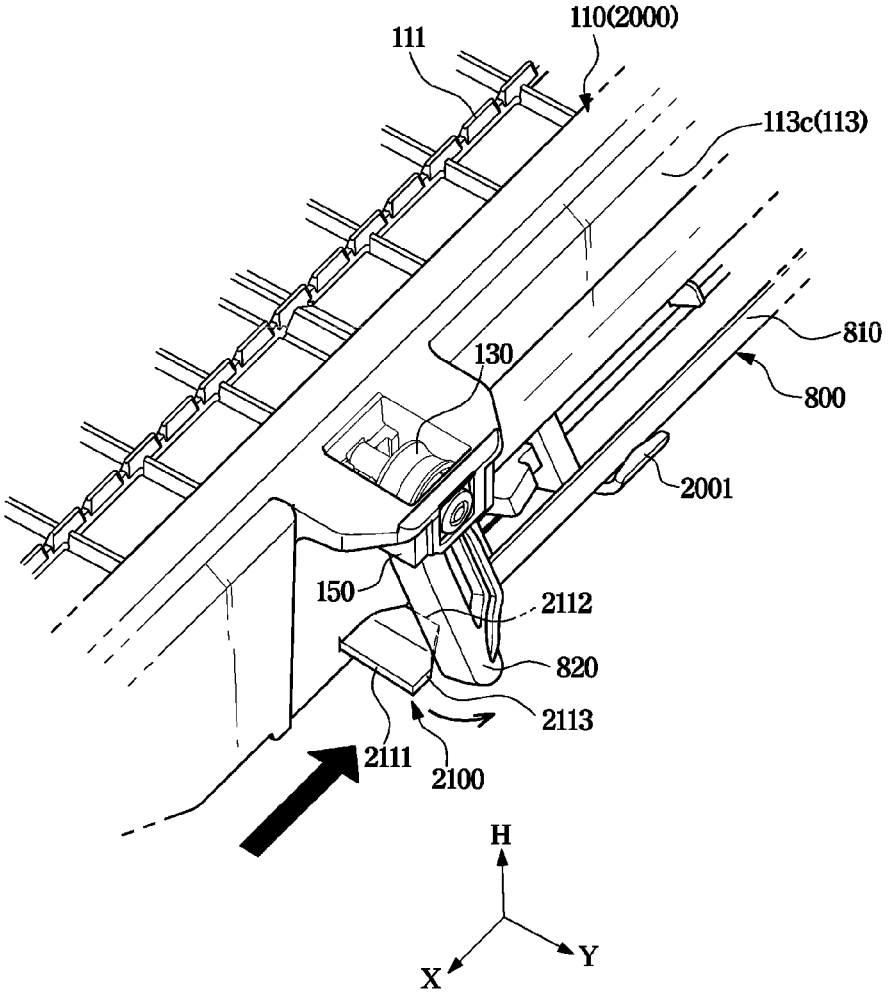
Figure 18C:
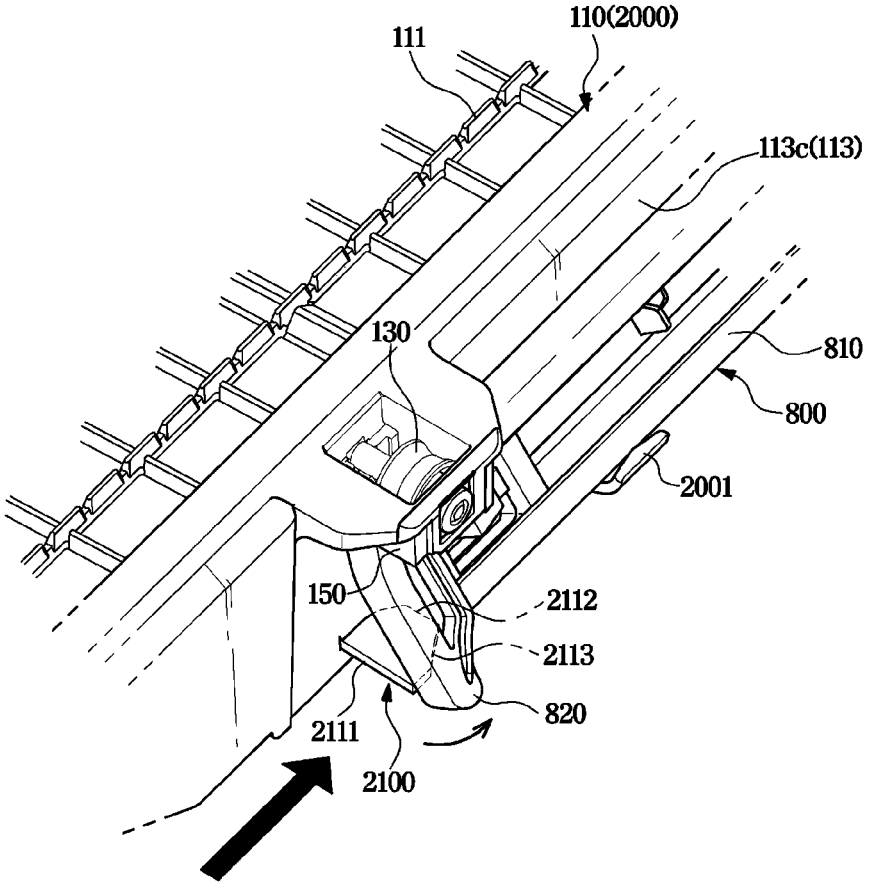

As illustrated in FIGS. 18B and 18C, the guide rail 800 may be twisted to such an extent that it may be returned to its original state by the stopper 2100 of the rack assembly 2000. The connection portion 2113 of the stopper 2100 may contact the first rail holder 820 of the guide rail 800 until the stopper 2100 passes the first rail holder 820 of the guide rail 800 and is located at the rear of the first rail holder 820. The degree of twisting of the guide rail 800 may be larger at the first end 2111 of the stopper 2100 than at the second end 2112 of the stopper 2100.

Figure 18D:
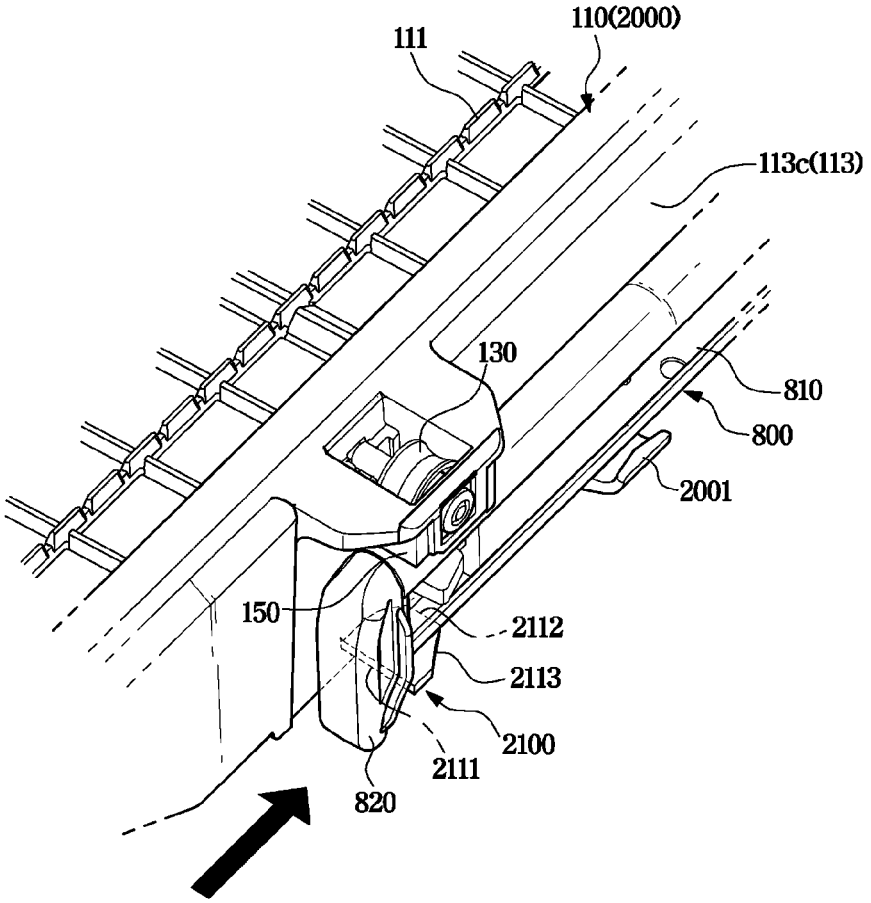

As illustrated in FIG. 18D, when the stopper 2100 of the rack assembly 2000 passes the first rail holder 820 of the guide rail 800 and is located at the rear of the first rail holder 820, the first rail holder 820 of the guide rail 800 may be restored to its original state as the contact or interference between the stopper 2100 and the first rail holder 820 is eliminated. When the rack assembly 2000 is completely coupled to the guide rail 800, the stopper 2100 may be located at a lower side of the rail body 810 of the guide rail 800 to be spaced apart from the rail body 810. Also, when the rack assembly 2000 is completely coupled to the guide rail 800, the first support holder 2090 of the rack assembly 2000 may be located above the guide rail 800 to be spaced apart from the guide rail 800.

Figure 20:
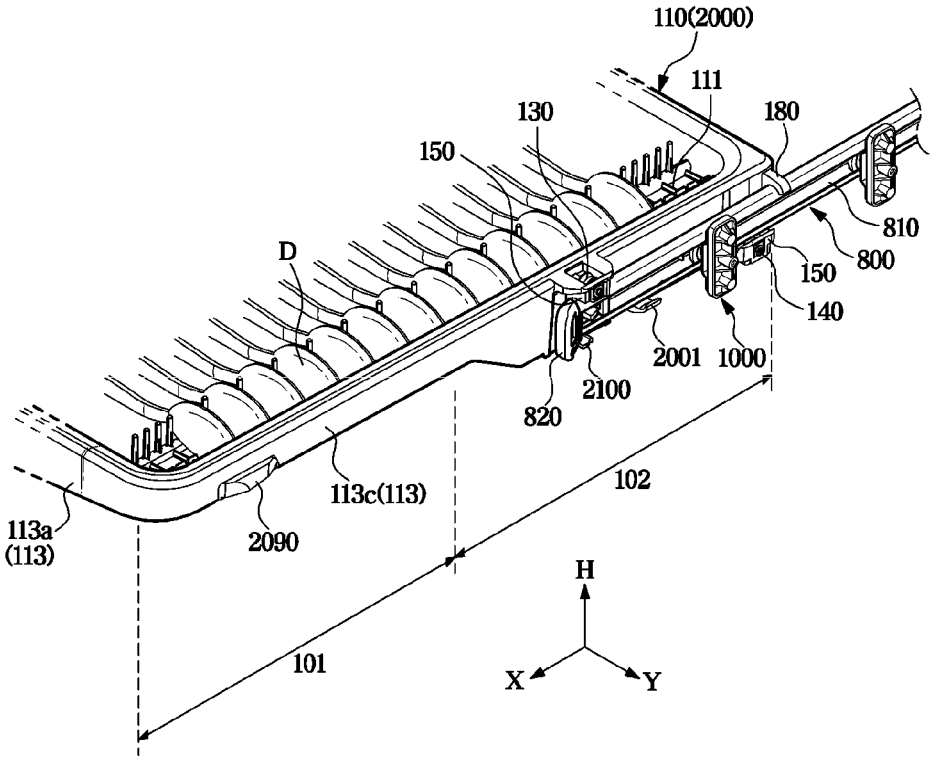
FIG. 20 is a perspective view of the rack assembly drawn out of the tub in the dishwasher according to an embodiment of the disclosure.

FIG. 19 is a perspective view of the rack assembly before being drawn out of a tub in the dishwasher according to an embodiment of the disclosure, and FIG. 20 is a perspective view of the rack assembly drawn out of the tub in the dishwasher according to an embodiment of the disclosure. "D" in FIGS. 19 and 20 indicates tableware. FIGS. 19 and 20 illustrate spoons as an example of the tableware.

As illustrated in FIGS. 19 and 20, the rack assembly 2000 is slidably movable along the guide rail 800. That is, the rack assembly 2000 may be drawn out of or inserted into the tub 12 along the guide rail 800.

As illustrated in FIG. 19, the rack assembly 2000 may be positioned inside the tub 12 in a state of being supported on the guide rail 800. The front portion 101 of the rack assembly 2000 may be supported on the guide rail 800 by the first support holder 2090. The rear portion 102 of the rack assembly 2000 may be supported on the guide rail 800 by the one or more rollers 130 and 140 and the second support holder 180.

The first support holder 2090 may extend from the wall 113 of the frame 110 to be supported on the upper portion of the guide rail 800 when tableware is accommodated in the rack assembly 2000. That is, the first support holder 2090 may extend from the wall 113 of the frame 110 to be hung on the upper portion of the guide rail 800 or to cover the upper portion of the guide rail 800 when tableware is accommodated in the rack assembly 2000.

As illustrated in FIG. 20, the draw-out of the rack assembly 2000 may be restricted by the interference of the first rail holder 820 and the stopper 2100. That is, the rack assembly 2000 may be drawn out of the tub 12 until the rack assembly 2000 is interfered by the first rail holder 820 and the stopper 2100.

When the rack assembly 2000 is drawn out of the tub 12, the front portion 101 of the rack assembly 2000 may be in a free state. That is, when the rack assembly 2000 is drawn out of the tub 12, the coupling of the first support holder 2090 and the guide rail 800 is released, and as a result, the front portion 101 of the rack assembly 2000 may be in a free state in which it is not supported by the guide rail 800. When the rack assembly 2000 is drawn out of the tub 12, the rear portion 102 of the rack assembly 2000 may be supported on the guide rail 800 by the one or more rollers 130 and 140 and the second support holder 180.

Although the rack assemblies 100, 200, 300, 400, 500, 600 and 2000 have been described above as examples of the accommodating containers, the various support structures described above may be applied not only to the rack assemblies 100, 200, 300, 400, 500, 600 and 2000 but also to a plurality of baskets 51 and 52.

The accommodating containers according to the disclosure may be applied not only to the dishwasher 1 illustrated in FIGS. 1 and 2 but also to various types of dishwashers.

As is apparent from the above, the stress or load that may be applied to the accommodating container can be evenly distributed to the front portion and the rear portion of the accommodating container by providing a support holder at the front portion of the accommodating container. Accordingly, a phenomenon in which a portion of the accommodating container is bent or sagged in the gravity direction can be easily prevented, and as a result, the sliding performance and the space utilization of the accommodating container can be improved.

The embodiments disclosed with reference to the accompanying drawings have been described above. However, it will be understood by those skilled in the art that various changes in form and details may be made therein without departing from the spirit and scope of the disclosure as defined by the appended claims.

What is claimed is:

1. A dishwasher comprising:

a main body;

a tub provided inside the main body and including an opening;

a door provided to open and close the opening of the tub;

a guide rail formed to be mounted on an inner wall of the tub;

an accommodating container provided to accommodate tableware and be movable along the guide rail, and including a front portion facing the opening and a rear portion;

at least one roller formed to be rotatably mounted on the rear portion of the accommodating container to movably couple the accommodating container to the guide rail so that the accommodating container is movable along the guide rail; and a support holder, at the front portion of the accommodating container and spaced apart from the at least one roller, the support holder being supportable by the guide rail, wherein the support holder is integrally formed with an upper portion of sidewall of the accommodating container in a protruding manner to be supported by the guide rail, wherein, while the support holder is supported by the guide rail, the support holder supports the front portion of the accommodating container and the at least one roller supports the rear portion of the accommodating container.

2. The dishwasher according to claim 1, wherein the support holder extends from the front portion of the accommodating container to be supported by an upper portion of the guide rail.

3. The dishwasher according to claim 1, wherein the guide rail includes a rail body fixed to the inner wall of the tub and including one end facing the opening, and a rail holder is coupled to the one end of the rail body and formed to extend downward from the guide rail.

4. The dishwasher according to claim 3, wherein the sidewall of the accommodating container faces the guide rail, and the support holder is formed on the upper portion of the sidewall of the accommodating container to avoid an interference with the rail holder.

5. The dishwasher according to claim 3, wherein the sidewall of the accommodating container faces the guide rail, and a stopper to interfere with the rail holder to restrict a movement of the accommodating container out of the tub is provided on the sidewall of the accommodating container.

6. The dishwasher according to claim 1, wherein the support holder includes a support holder body, and the support holder body includes a first wall facing the opening, and a second wall facing the first wall and having a height lower than a height of the first wall.

7. The dishwasher according to claim 1, wherein the at least one roller includes a first roller provided to be supported on an upper portion of the guide rail, and a second roller positioned at a lower side of the guide rail to support the accommodating container together with the support holder and the first roller.

8. The dishwasher according to claim 7, wherein the support holder and the first roller are positioned apart from each other at an upper side of the guide rail.

9. The dishwasher according to claim 1, further comprising a support portion formed to extend from the inner wall of the tub to support the support holder.

10. The dishwasher according to claim 1, wherein the sidewall of the accommodating container faces the guide rail, the support holder includes a support holder body, and the support holder body includes a first wall formed to extend from the sidewall of the accommodating container to be positioned at an upper side of the guide rail and provided with a support protrusion protruding to contact the guide rail, and a second wall formed to extend downward from the first wall to cover the guide rail together with the first wall.

11. The dishwasher according to claim 1, wherein the guide rail includes:

one end facing the opening, and a support portion formed to extend toward an inside of the tub from the one end of the guide rail to support the support holder.

12. The dishwasher according to claim 1, wherein the accommodating container includes a loading portion to accommodate the tableware and a frame wall disposed along a perimeter of the loading portion, and the loading portion and the frame wall include a plastic material.

13. A dishwasher comprising:

a main body;

a tub provided inside the main body and including an opening;

a door provided to open and close the opening of the tub;

a guide rail formed to be mounted on an inner wall of the tub, and including a rail body including an end facing the opening and a rail holder coupled to the end of the rail body and formed to extend downward from the guide rail;

an accommodating container provided to accommodate tableware and be movable along the guide rail; and a support holder, at a front portion of the accommodating container and spaced apart from at least one roller, the support holder being supportable by the guide rail, wherein the support holder is integrally formed with an upper portion of sidewall of the accommodating container in a protruding manner to be supported by the guide rail, wherein, while the support holder is supported by the guide rail, the support holder supports the front portion of the accommodating container and the at least one roller supports a rear portion of the accommodating container.

14. The dishwasher according to claim 13, wherein the front portion of the accommodating container faces the opening and the rear portion of the accommodating container, and the support holder is provided on the front portion of the accommodating container.

15. The dishwasher according to claim 14, wherein the at least one roller is rotatably mounted on the rear portion of the accommodating container to movably couple the accommodating container to the guide rail so that the accommodating container is movable along the guide rail.

16. The dishwasher according to claim 13, wherein the support holder extends from a front portion of the accommodating container to be supported by an upper portion of the guide rail.

17. The dishwasher according to claim 13, wherein the end facing the opening is a first end, and the rail body further includes a second end fixed to the inner wall of the tub and positioned at an opposite side of the rail body from the first end facing the opening, and the guide rail further includes a rail holder which is coupled to the second end of the rail body and extending upward from the guide rail.

18. The dishwasher according to claim 13, wherein the sidewall of accommodating container faces the guide rail, and a stopper to interfere with the rail holder to restrict a movement of the accommodating container out of the tub is provided on the sidewall of the accommodating container.

19. The dishwasher according to claim 13, wherein the accommodating container includes a loading portion to accommodate the tableware and a frame wall disposed along a perimeter of the loading portion, and the loading portion and the frame wall include a plastic material.

20. A dishwasher comprising:

a main body;

a tub provided inside the main body and including an opening;

a door provided to open and close the opening of the tub;

a guide rail formed to be mounted on an inner wall of the tub;

an accommodating container provided to accommodate tableware and be movable along the guide rail;

a plurality of rollers formed to be rotatably mounted on the accommodating container to movably couple the accommodating container to the guide rail so that the accommodating container is movable along the guide rail, the plurality of rollers including a first roller positioned at an upper side of the guide rail and a second roller positioned at a lower side of the guide rail; and a support holder, at a front portion of the accommodating container and spaced apart from the plurality of rollers which includes the first roller and the second roller, the support holder being supportable by an upper side of the guide rail, wherein the support holder is integrally formed with an upper portion of sidewall of the accommodating container in a protruding manner to be supported by the guide rail, wherein, while the support holder is supported by the guide rail, the support holder supports the front portion of the accommodating container and at least one roller among the plurality of rollers supports a rear portion of the accommodating container.

* * * * *